US005524471A

United States Patent [19]

Nielsen

[11] Patent Number: 5,524,471

[45] Date of Patent: Jun. 11, 1996

[54] APPARATUS FOR MAKING SCREWS, RIVETS OR SIMILAR OBJECTS

[75] Inventor: Ove Nielsen, Skanderborg, Denmark

[73] Assignee: Enkotec A/S, Skanderborg, Denmark

[21] Appl. No.: 295,628

[22] PCT Filed: Mar. 3, 1993

[86] PCT No.: PCT/DE93/00078

§ 371 Date: Oct. 27, 1994

§ 102(e) Date: Oct. 27, 1994

[87] PCT Pub. No.: WO93/17810

PCT Pub. Date: Sep. 16, 1993

[30] Foreign Application Priority Data

Mar. 3, 1992 [DK] Denmark ..... 0279/92

[51] Int. Cl.[6] ..... B21J 5/08; B21K 1/46; B21K 1/58

[52] U.S. Cl. ..... 72/339; 470/40; 470/129; 470/140; 470/904

[58] Field of Search ..... 470/28, 40, 72, 470/123, 129, 140, 904, 69, 90, 153, 156; 72/339, 338

[56] References Cited

U.S. PATENT DOCUMENTS

| | | | |
|---|---|---|---|
| 102,418 | 4/1870 | Morgan | 470/140 |
| 311,969 | 2/1885 | Fischer | 470/140 |
| 2,396,995 | 3/1946 | Friedman | 10/12 |
| 3,635,389 | 1/1972 | Shibata | 470/40 |
| 4,052,763 | 10/1977 | Dunkin | 470/28 |

FOREIGN PATENT DOCUMENTS

| | | | |
|---|---|---|---|
| 56291 | 11/1912 | Austria | 470/140 |
| 867944 | 2/1953 | Germany . | |
| 933430 | 9/1955 | Germany . | |

*Primary Examiner*—Daniel C. Crane
*Attorney, Agent, or Firm*—Ladas & Parry

[57] ABSTRACT

In a method of making screws, rivets or similar objects from a metal wire (6) the wire (6) is moved through a stationary cropping bushing (14) forwardly to a movable cropping bushing (24) present in a receiving position, following which the movable cropping bushing (24) is moved away from the receiving position substantially transversely to the axial direction of the wire to release a blank from the wire (6). The movable cropping bushing (24, 25) is then moved together with the released blank (26) further on to a discharge position, in which a punch (27) is adapted to move the blank (26) partly into a die (16) and to compress the blank (26) sufficiently to pre-upset it by cold flowing in the region between the die (16) and the movable cropping bushing (25). In an apparatus of making screws, rivets or similar objects the movable cropping bushing (24, 25) is secured to a transport device (15), by means of which it can be moved from a receiving position opposite the stationary bushing (14) to a discharge position opposite a die (16) between said die and a punch (27), which is adapted to move the blank (26) partly into the die (16) and to compress the blank (26) sufficiently to pre-upset it by cold flowing in the region between the die (16) and the movable cropping bushing (25).

13 Claims, 22 Drawing Sheets

104
102

APPARATUS FOR MAKING SCREWS, RIVETS OR SIMILAR OBJECTS

FIELD OF THE INVENTION

The invention concerns an apparatus for making screws, rivets or similar objects, wherein a metal wire is passed through a stationary cropping bushing forwardly to a movable cropping bushing present in a receiving position, following which the movable cropping bushing is moved away from the receiving position substantially transversely to the axial direction of the wire to release a blank from the wire.

In the making of e.g. screws it is known to use an upsetting process wherein a blank is retained in a die, one end of the blank being formed by a punch or a tool.

Before a bland can be placed in such a die, the blank is provided by e.g. cutting from a wire. This typically takes place by a so-called cropping process wherein a wire is moved through a cropping bushing into a cropping tool. Release of a blank from the wire then takes place by briefly moving the cropping tool transversely to the longitudinal direction of the wire. This cropping tool is often open such that a so-called open cropping is performed.

The resulting blank is then to be moved by means of some form of transport mechanism to a position outside the die where further shaping is to take place. Here, a punch can move the blank into the die and then perform a pre-upsetting operation, the die being closed at the other end by a bottom stop, e.g. in the form of an ejector pin.

A relatively complicated transport mechanism is necessary for moving the released blank from the cropping position and forwardly for insertion into the die. The cropping tool itself may form part of the transport mechanism, but in that case it must be removed from the position in front of the die while the punch moves the blank into the die, which limits the production rate.

In addition to the complicated transport mechanism, this technique has the drawback that the mentioned open cropping does not provide an optimum quality of the resulting blanks, unless a complicated holding mechanism retains the wire in the tool during the cropping process. The disuniform quality of the blanks impedes optimum control of the subsequent steps in the forming process.

It is also known to use so-called closed cropping in other connections, wherein the employed cropping tool has the shape of a closed cropping bushing, which gives a much better quality of the resulting blanks. The use of this principle in traditional screw machines requires a complicated transport mechanism and also another ejector pin to eject the blank from the cropping bushing. This entails that an additional process step is introduced, which reduces the production rate.

From DE-C-933 430 a device is known in which after release of a blank from the wire the movable cropping bushing together with the released blank is moved further on to a discharge position where a punch is adapted to move the blank partly into the die and to compress the blank sufficiently to upset it by cold flowing in the region between the die and the movable cropping bushing.

SUMMARY OF THE INVENTION

One advantage provided by the invention is that the closed cropping gives an optimum quality of the resulting blanks, another being a high production rate because of the avoidance of extra process steps for transporting the blank from the cropping position and forwardly for insertion into the die where the blank is optimally aligned with respect to the die, which minimizes wear.

This is achieved according to the invention in that at least two movable cropping bushings are provided, arranged in a manner such that movable cropping bushings can be present simultaneously in the cropping or receiving position and the discharge position opposite the die, respectively. In this way it will be possible to achieve a particularly high production rate, since wire can be inserted into the one cropping bushing while a blank at the other bushing is moved into the die and is pre-upset.

In a special embodiment a plurality of movable cropping bushings are arranged in a rotatable cropping table capable of assuming a plurality of positions which corresponds to the number of movable cropping bushings. This provides a very expedient structure, because a rotary movement of the cropping bushing causes release of a blank at the cropping position while the cropping bushing concerned is moved forwardly to its next position.

BRIEF DESCRIPTION OF THE DRAWING FIGURES

The invention will be described more fully below with reference to the drawing, in which FIG. 1 is a perspective view of a screw machine, FIG. 2 is a sectional view of a cropping mechanism, FIG. 3 is a perspective view of a cropping mechanism, FIGS. 4A and 4B show the pre-upsetting process, FIG. 5 shows an alternative pre-upsetting process, FIG. 6 shows curve control of a pre-upsetting pin, FIG. 7 shows an embodiment of the control from FIG. 6, FIG. 8 shows an alternative embodiment of the control in FIG. 6, FIGS. 9A and 9B show the second pre-forming of a screw head, FIG. 10A and 10B show forming of a slot in a screw head, FIG. 11 shows the making of a screw point, FIG. 12 shows the ejection of a blank from a die with a short ejector pin, FIG. 13 shows the ejection of a blank from a die with a long ejector pin, FIGS. 14A and 14B show the use of a slot detector, FIG. 15 shows the making of a holding flange, FIG. 16 shows a mechanism which converts a rotary movement to a reciprocating movement, FIG. 17 shows an alternative embodiment of the mechanism from FIG. 16, FIG. 18 is a sketch of a crank and a connection rod, FIG. 19 are curves showing motion and speed of a crank mechanism, FIGS. 20A–20D show how the die table can be controlled by a curve path, FIG. 21 shows motion and speed of the die table and bottom stop without transition periods, FIG. 22 corresponds to FIG. 21, but with inserted transition periods, FIG. 23 corresponds to FIG. 22, but without a dwell period, FIG. 24 shows the mounting of a die in a die table, FIG. 25 is a section through a die table with a die, and FIG. 26 shows how a die table can be constructed.

DETAILED DESCRIPTION

Figure 1:
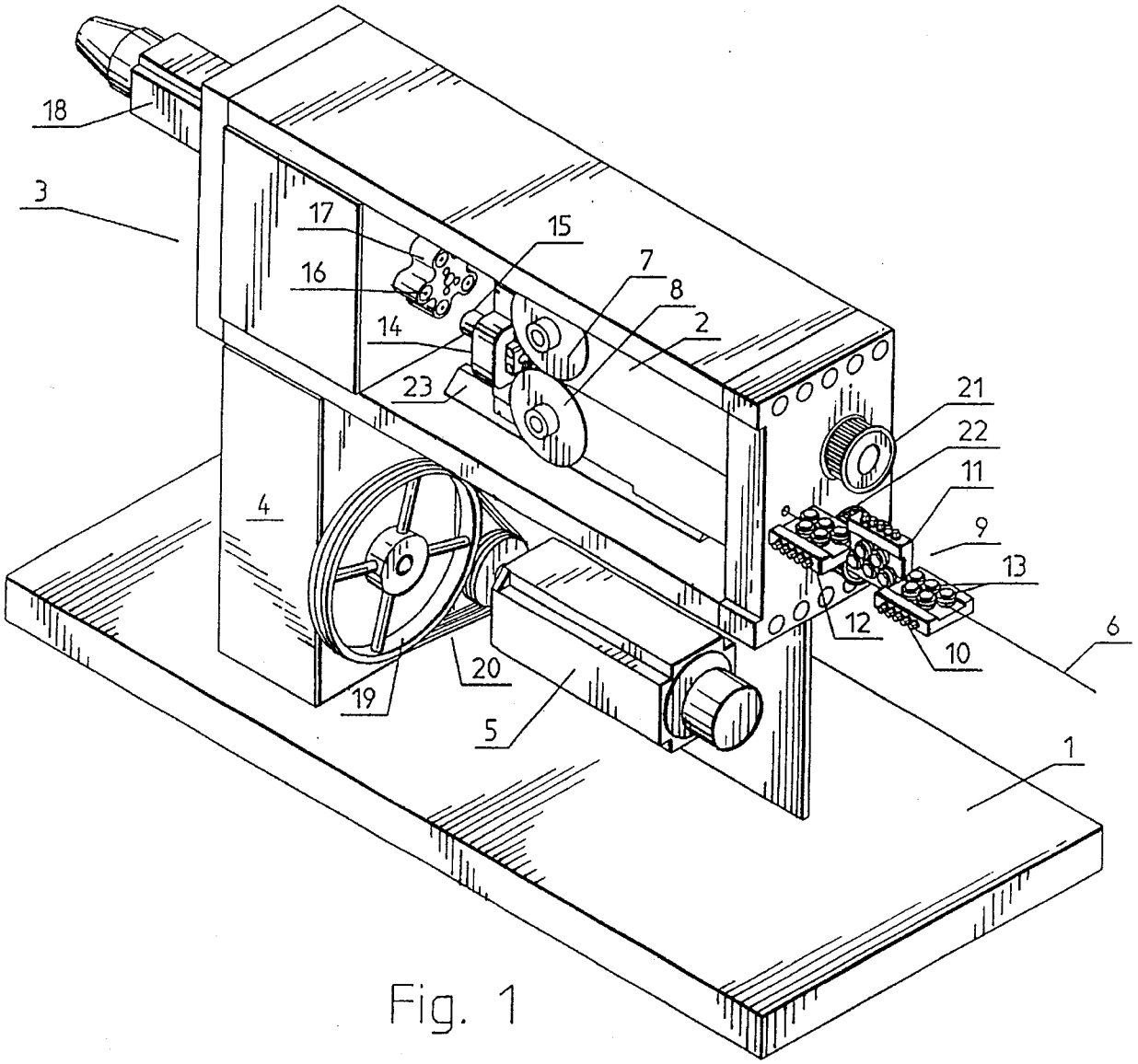

FIG. 1 shows an example of a screw machine in which the invention may be used. The machine is mounted on a base plate 1 and generally consists of three main parts, viz. a tool table 2, a forming mechanism 3 and a crank mechanism 4. The machine is driven by a motor 5 which is mounted on the base plate 1.

The starting material for the making of screw blanks is a cold drawn wire 6, which is provided with a lubricating film on the surface originating from the drawing of the wire. The wire is drawn by means of two draw rollers 7, 8 having grooves corresponding to the employed wire diameter through a straightening device 9, which consists of a plurality of straightening units 10, 11, 12, each of which being in turn provided with a plurality of rollers 13.

The draw rollers 7, 8 move a given length of wire forwardly through a stationary cropping bushing 14 and into a movable cropping bushing mounted in a rotatable cropping table 15. In a cropping process, which will be described more fully below, a wire blank is separated from the wire 6.

As will likewise be described more fully below, the wire blank is then moved into a die 16 which is mounted in a rotatable die table 17. The die table here has five dies and can rotate between five positions. It is moreover axially movable. In a specific position of the die table 17, e.g. a movable cropping bushing in the cropping table 15 will be present opposite the die 16. Correspondingly, tools will be mounted on the tool table opposite others of the dies of the die table, said tools, in cooperation with the dies, being capable of forming the screw blanks arranged in the dies. Forming takes place in that the die table 17 is moved axially toward the tools in a working stroke. The die table 17 is then withdrawn again, and it can rotate to the next position, following which the process is repeated.

The rotating movement of the die table 17 can be established by a motor 18 adapted for the purpose. Its axial movement is provided from the crank mechanism 4 and is driven by the previously mentioned motor 5. Power transmission from the motor 5 to the crank mechanism 4 takes place by means of a pulley 19 and a belt 20.

By means of two pulleys 21, 22 which are connected to a motor (not shown), the entire tool table 2 can be moved in a direction away from or toward the die table 17, the tool table 2 being guided by a slide bar 23 on the under side of the tool table and a corresponding one (not visible in the figure) on the upper side. The tool table 2 can hereby be adjusted to its correct position, and it is also possible to draw the tool table away from the die table 17 in case of e.g. replacement of tools or die table.

The individual parts or processes in the machine will be described more fully below.

Figure 2:
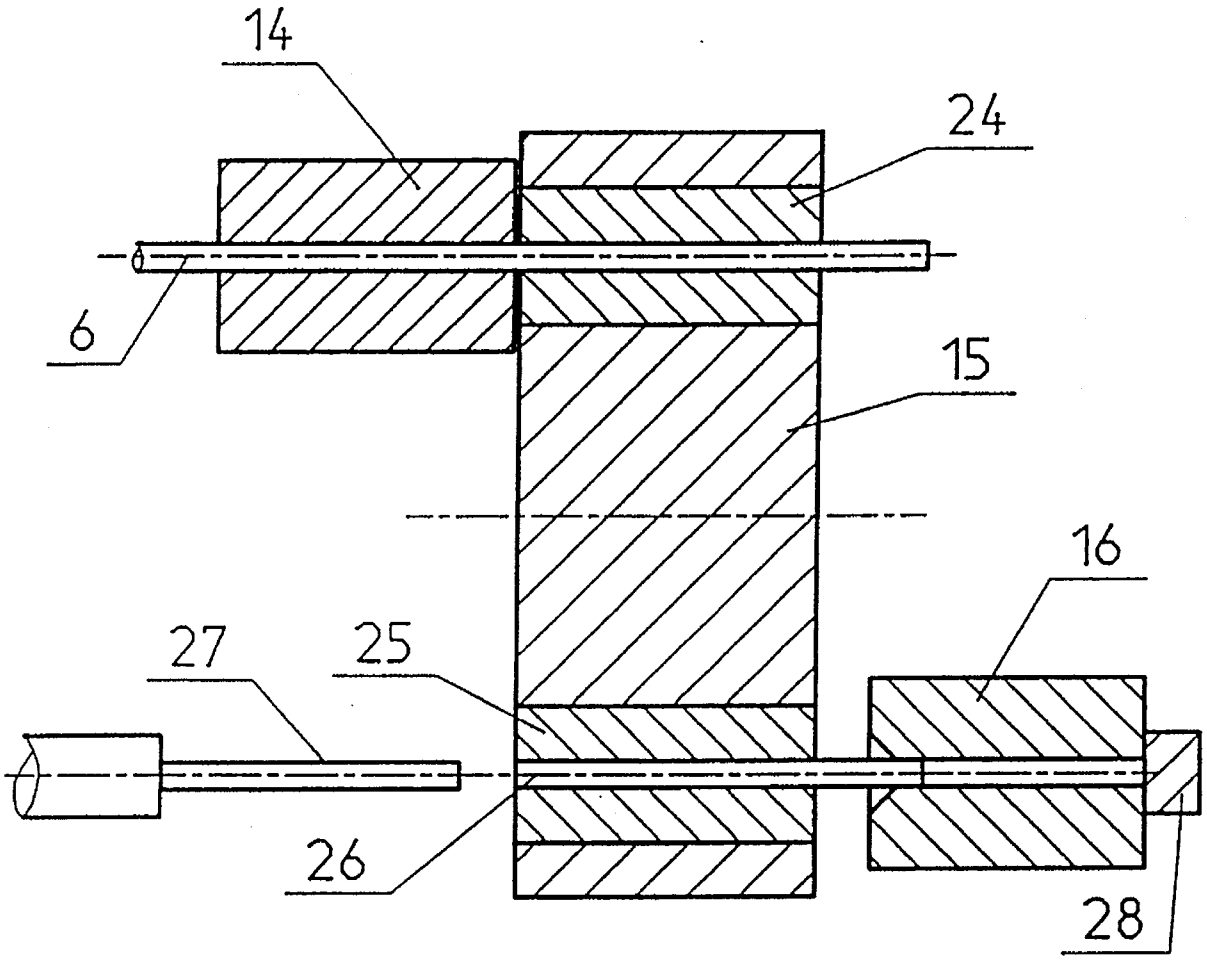
Figure 3:
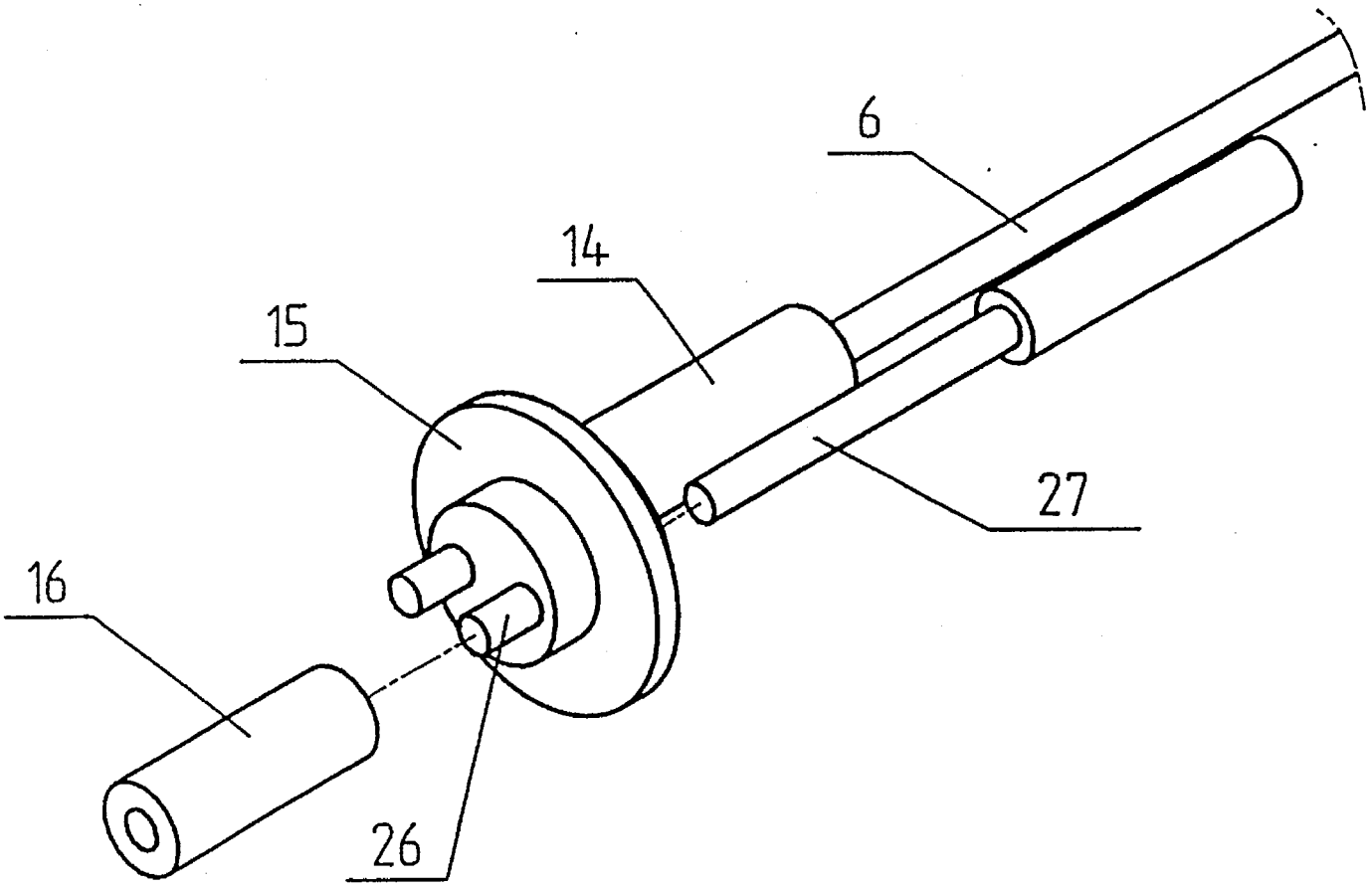

It is shown in FIGS. 2 and 3 how cropping and pre-upsetting take place. FIG. 2 is a cross-section of the constituent parts while FIG. 3 is a perspective view.

The wire 6 is moved forwardly through the stationary cropping bushing 14 and into a movable cropping bushing 24 which, as mentioned before, is mounted in a rotatable cropping table 15. The cropping table 15 has a plurality of movable cropping bushings 24, 25. When the wire 6 has been moved forwardly to the correct length, the rotatable cropping table 15 is rotated, causing a wire blank to be separated from the wire 6. Further rotation of the cropping table 15 moves the movable cropping bushing forwardly to a position opposite a die 16, here shown at the cropping bushing 25. The released wire blank is here designated 26.

When the movable cropping bushing has been placed in this position, a punch 27 is moved forwardly toward the bushing and thereby pushes the blank 26 out of the movable cropping bushing 25 and into a die 16. This movement continues until the blank 26 hits a bottom stop 28, which is positioned at the opposite end of the die 16. However, the punch 27 continues its movement, whereby the blank 26 is pre-upset or pre-formed in the cavity i.e. predetermined unrestricted axial space between the die 16 and the movable cropping bushing 25. The punch 27 thus also serves as a pre-upsetting pin and the movable cropping bushing as a pre-upsetting bushing. The blank is thereby formed with a pre-upset head in said space and a shank extending from said head into said die 16.

As described, so-called closed cropping is thus used here, the stationary cropping bushing as well as the movable cropping bushing 24 having a hole corresponding to the diameter of the wire. In traditional presses or screw machines so-called open cropping is frequently used, comprising a stationary cropping bushing with a hole, whereas the movable bushing is open so that the wire blank is supported only in the direction of travel. The closed cropping used here results in optimum quality of the separated blank. Since the quality of the finished object depends upon the quality of all the constituent processes, a higher quality of the separated wire blanks thus also means a higher quality of the finished objects.

The figures show two movable cropping bushings 24, 25 which are so arranged in the rotatable cropping table 15 that one is present opposite the die 16 when the other is present opposite the stationary cropping bushing 14. However, more cropping bushings may advantageously be mounted in the cropping table 15. This will give a smaller angle of rotation at each separation. Thus, if e.g. four movable cropping bushings are used, the cut wire blank will reach a position opposite the punch or the pre-upsetting pin 27 and die 16 after two angular rotations of the rotatable cropping table 15.

Figure 4B:
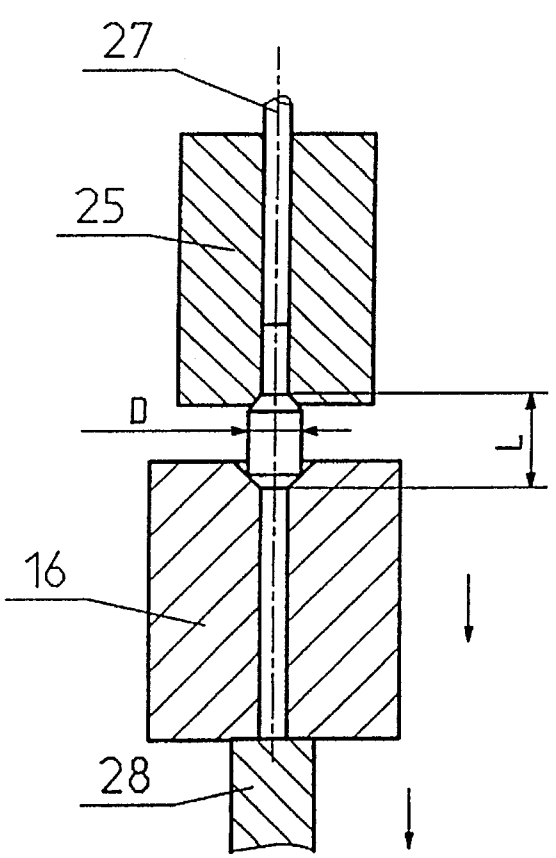
Figure 4A:
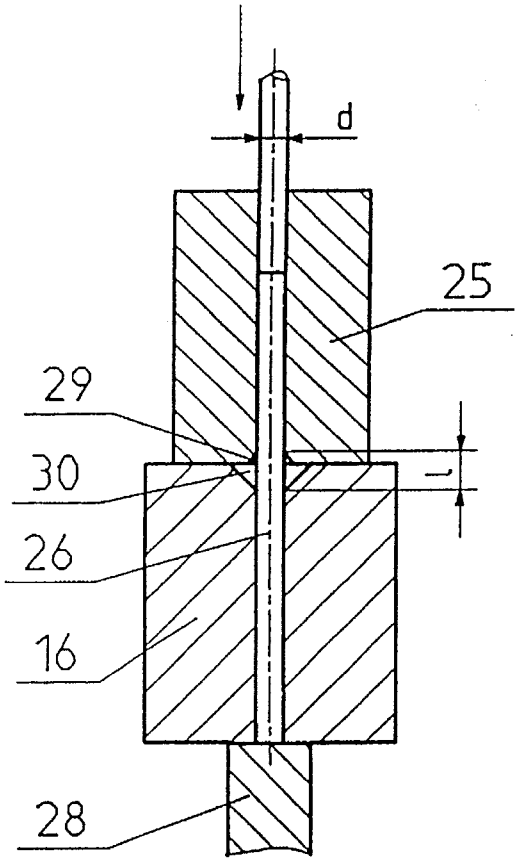

It is shown more clearly in FIG. 4 how the pre-upsetting process proceeds. As described before, the die 16, which is mounted in the die table 17, is moved together with the associated bottom stop 28 in the axial direction of the die. On the other hand, the movable cropping bushing 25 cannot be moved in the axial direction. FIG. 4A shows the situation precisely at the time when pre-upsetting is initiated. The pre-upsetting pin 27 pushes the wire blank 26 out of the bushing 25 and into the die 16 such that the blank 26 reaches the bottom stop 28 immediately before the die 16 at its turning point is in contact with the pre-upsetting bushing 25. An expansion 29 of the hole in the pre-upsetting bushing is provided at the end of the bushing 25 facing the die 16. A corresponding expansion 30 is provided in the die 16. These cavities enable pre-forming of a head on the wire blank 26.

Figure 5:
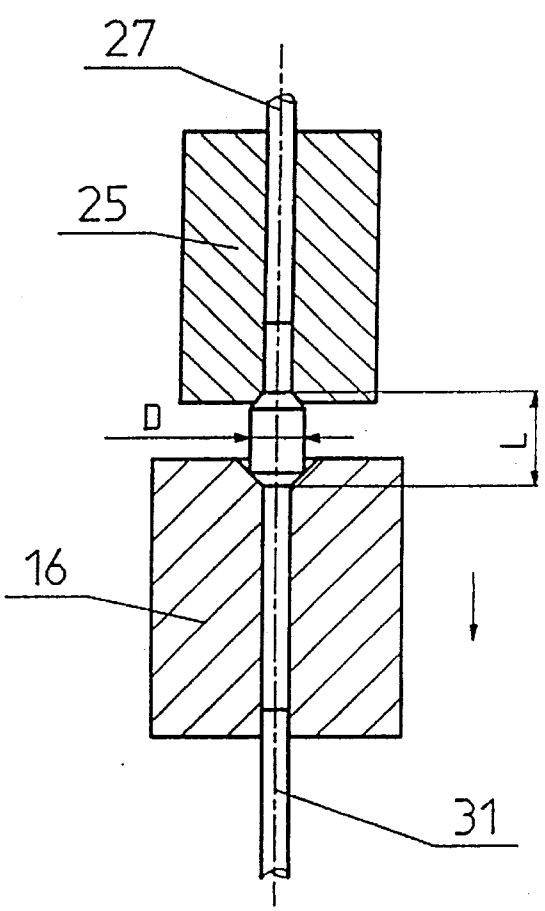

These cavities are shaped so that the free length 1 of the wire blank 26 will be as small as possible with respect to the diameter d of the blank. The pre-upsetting pin 27 is controlled so that pre-upsetting continues after the die 16 has again initiated its movement away from the bushing 25. This gives an increased height of the pre-upset while increasing the diameter of the pre-form, so that the volume of the pre-formed material can be increased without the pre-form becoming unstable, so that the upsetting ratio is not restricted by the process. The upsetting ratio is the head wire length divided by the wire diameter. FIG. 4B shows the situation at the termination of the pre-upsetting process. The pre-formed head now has the height L and the diameter D. In addition to a greater upsetting ratio, this method also results in reduced loads on the pre-upsetting pin. FIG. 5 shows an alternative embodiment, using instead of the bottom stop 28 a movable bottom stop, e.g. in the form of an ejector pin 31 which can be moved with respect to the die 16. It will hereby be possible to control the process even better.

Figure 6:
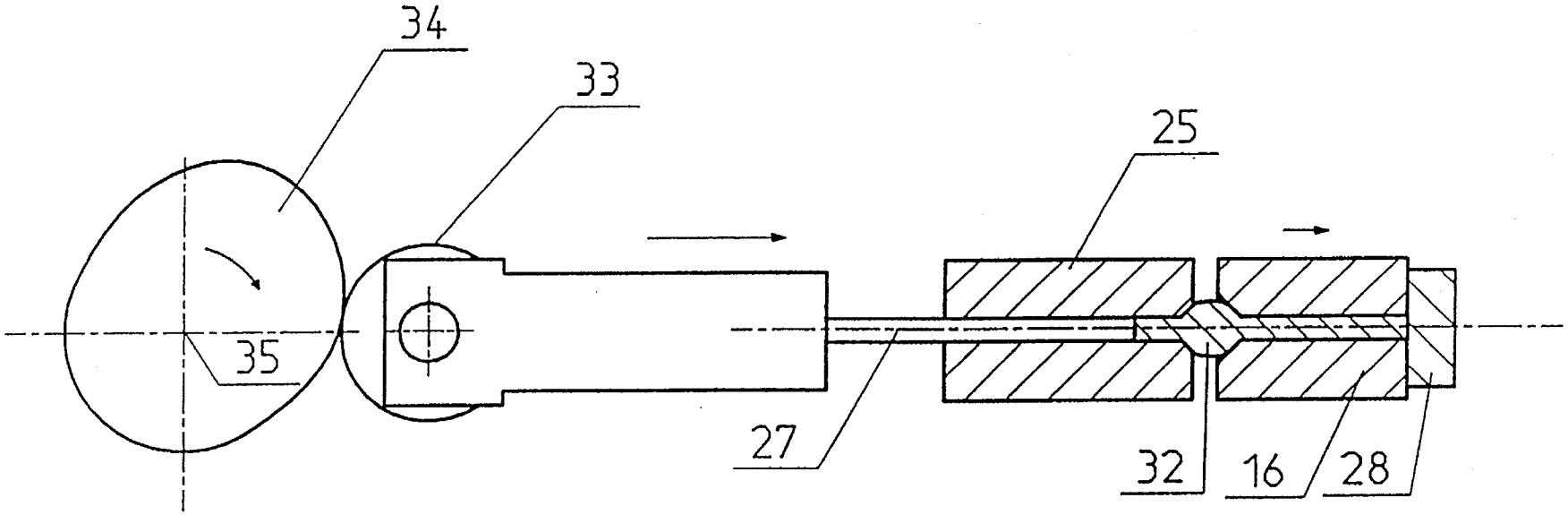

For the process shown in FIG. 4 to be optimized, the movement of the pre-upsetting pin 27 must be controlled very precisely with respect to the movement of the die 16. FIG. 6 shows an example of how this can be done. The previously described parts are shown to the right in the figure. It will be seen that the die 16 and the bottom stop 28 are being moved away from the bushing 25, so that a head 32 will be formed on the wire blank, the punch or pre-upsetting pin 27 still pressing in a direction toward the die 16. A roller 33 is provided at the end of the pre-upsetting pin 27 and is in contact with the surface of a curve path 34. The curve path 34 rotates about the axis of rotation 35, and the curve path 34 is constructed such that the desired movement of the pre-upsetting pin 27 is achieved.

Figure 7:
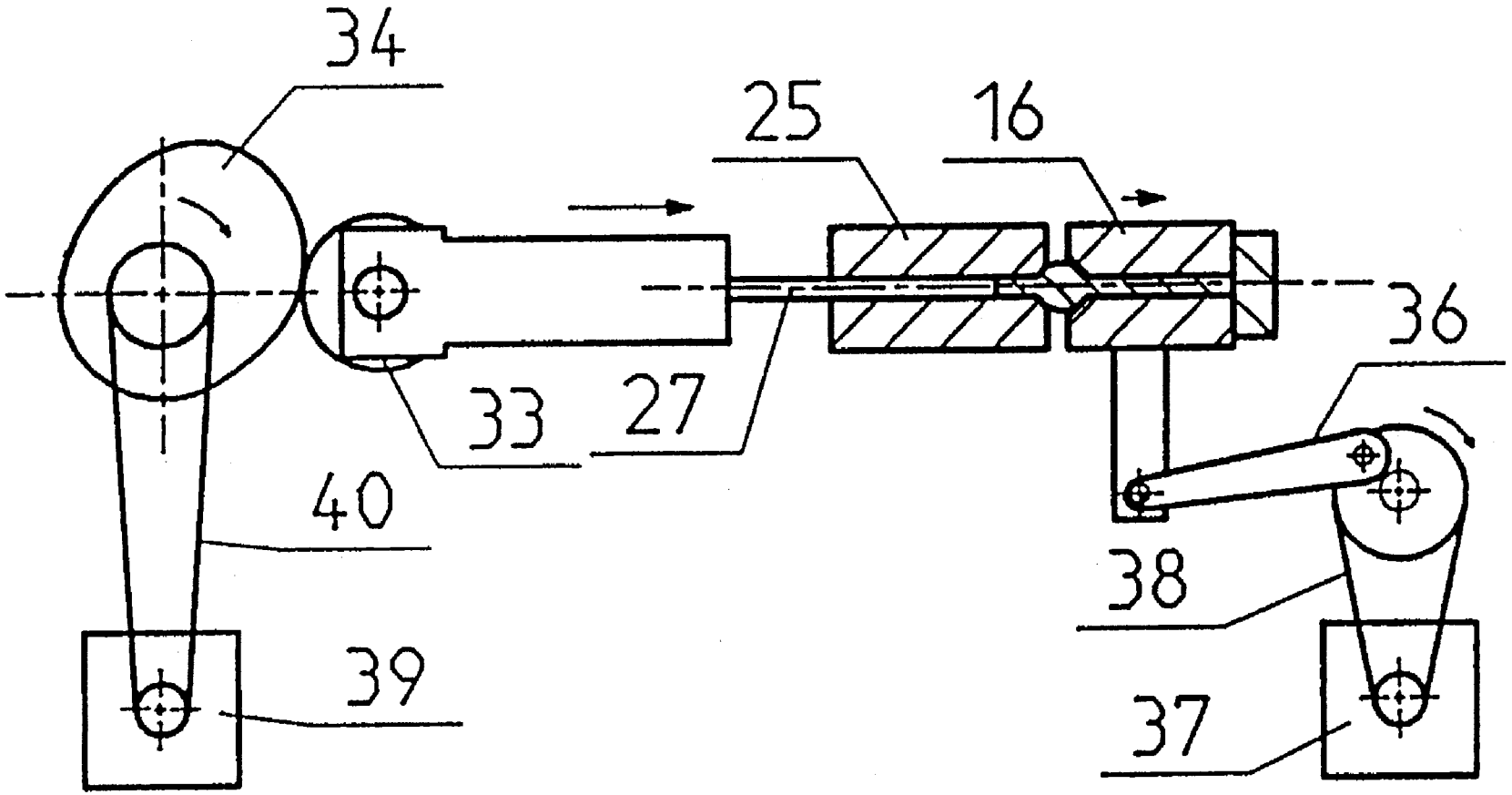

FIG. 7 shows an example of how the mentioned movements can be provided. The reciprocating movement of the die 16 is here provided by a crank mechanism 36 which is driven by a motor 37 by means of a belt 38. The movement of the pre-upsetting pin 27 is provided by another motor 39 which drives the curve path 34 via another belt 40, thereby transferring the desired movement via the roller 33 to the pre-upsetting pin 27.

Figure 8:
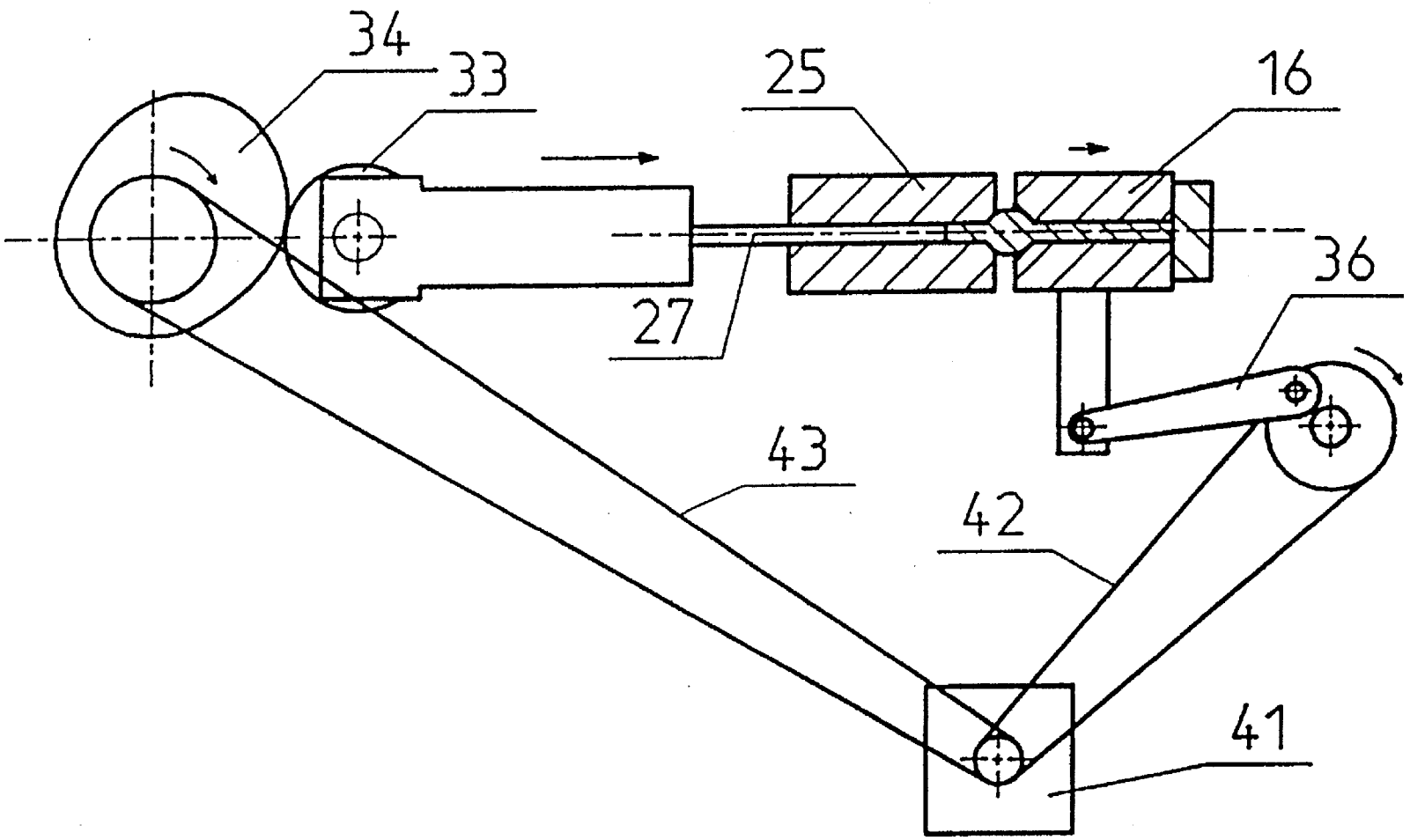

Alternatively, as shown in FIG. 8, the two movements can also be controlled by a common motor 41. This motor drives, via a belt 42, the crank mechanism 36 which transfers the movement to the die 16. By means of another belt 43 the same motor drives the curve path 34 which transfers the movement to the pre-upsetting pin 27 via the roller 33.

When the pre-upsetting process, which can also be called first pre-forming here, has been terminated and the die table 17 has been drawn back, the table can be rotated to a new position. In the embodiment of the rotatable die table 17 shown in FIG. 1, where said table comprises five dies 16, the die table will now be rotated 72°, so that a new die is moved forwardly to the position opposite a movable cropping bushing, while the die having just been present here is moved forwardly to a new position. When the die table 17 is again moved forwardly toward the tool table 2, the process described above will be repeated at the cropping or pre-upsetting bushing, while further shaping of the blanks arranged in the dies will take place at the other die positions.

Figure 9B:
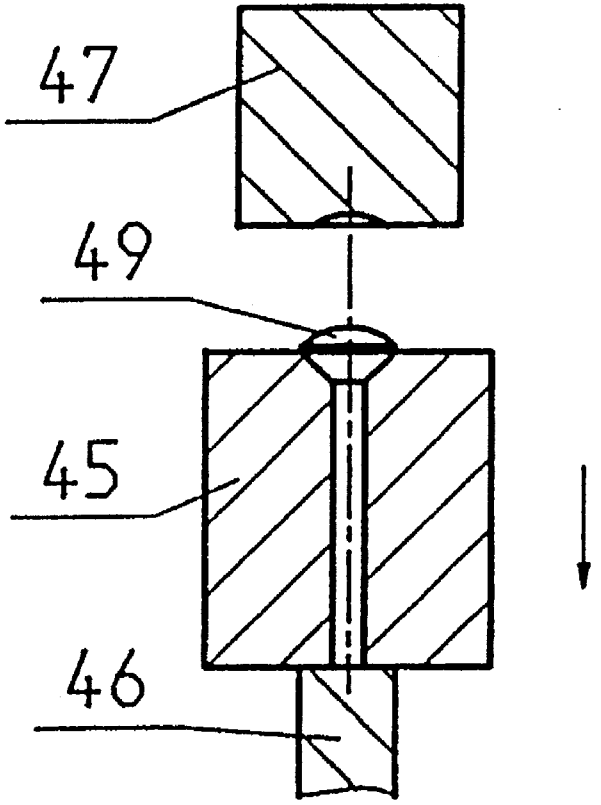
Figure 9A:
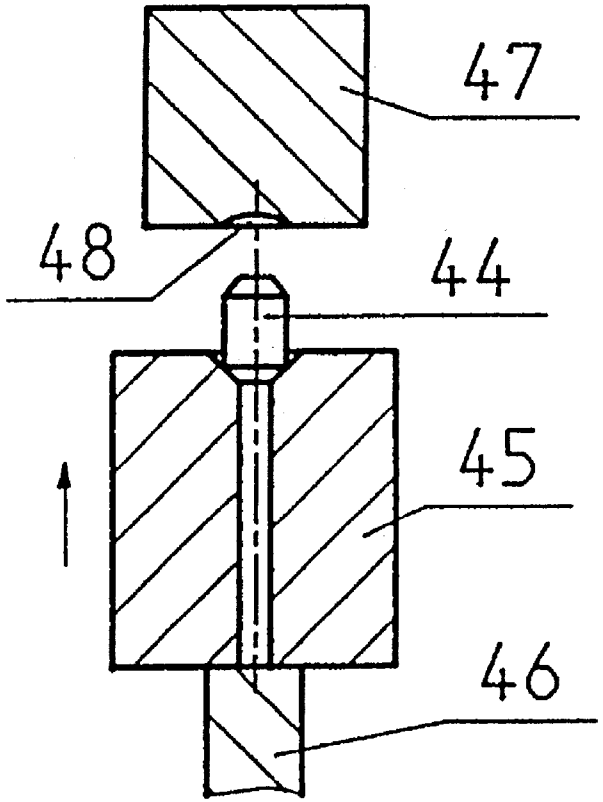

FIG. 9 shows an example of a process which can follow the pre-upsetting process described above. The process shown here is called second pre-forming. FIG. 9A shows the situation at the beginning of this process, while FIG. 9B correspondingly shows the situation immediately after it has been completed. In FIG. 9A a blank is placed in a die 45 which, together with a bottom stop 46, is moved toward a tool 47. The tool 47 is positioned stationarily on the tool table 2, while, as described before, it is the die 45 arranged in the die table 17 which moves toward and then away from the tool 47. When the head on the blank 44 hits the tool 47, it will be formed to the desired shape by a depression 48 in this tool. It is shown in FIG. 9B how the blank 44 has now been formed to the blank 49 shown here. The blank 49 together with the die 45 and the bottom stop 46 are being moved away from the tool 47.

Figure 10B:
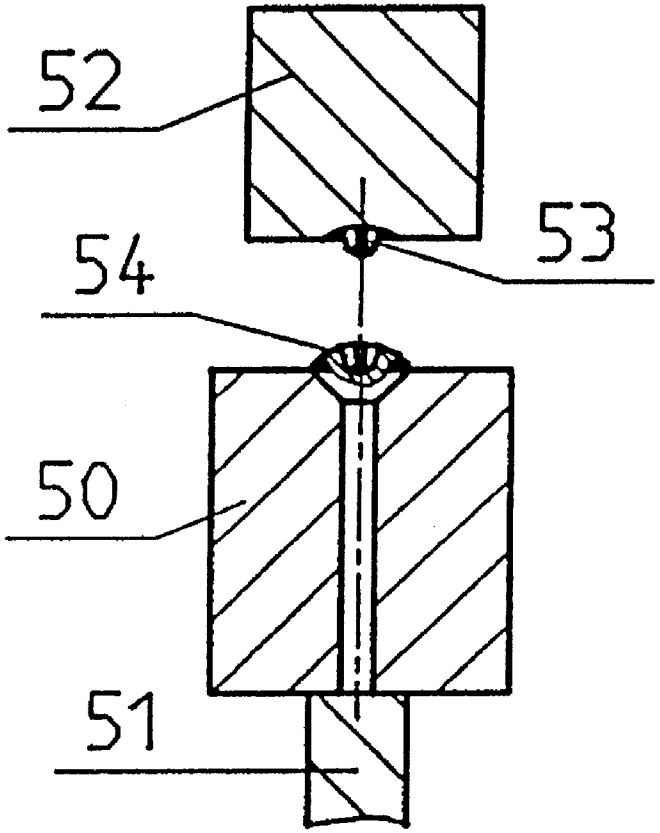
Figure 10A:
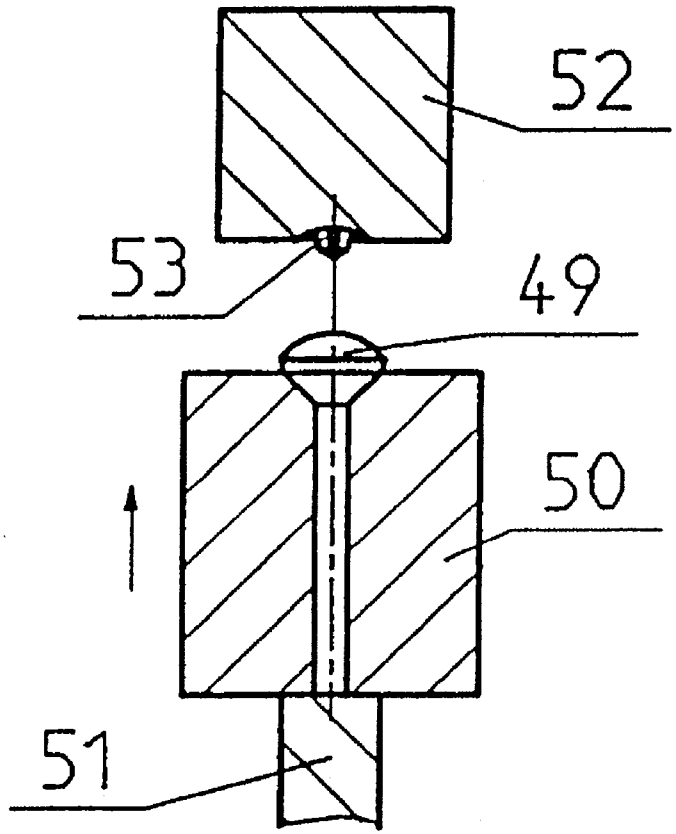

FIG. 10 correspondingly shows a forming that may take place at a third die position. In this process a slot or the like is produced in the screw head just formed. The blank 49 is now present in a die 50 which, together with a bottom stop 51, is moved toward a tool 52. The tool 52 is provided with a slot projection 53 which forms a slot in the head of the blank 49. FIG. 10A shows the situation at the start of the process, while FIG. 10B shows the situation at the termination of the process, the numeral 54 designating the blank with the slot now produced.

Figure 11:
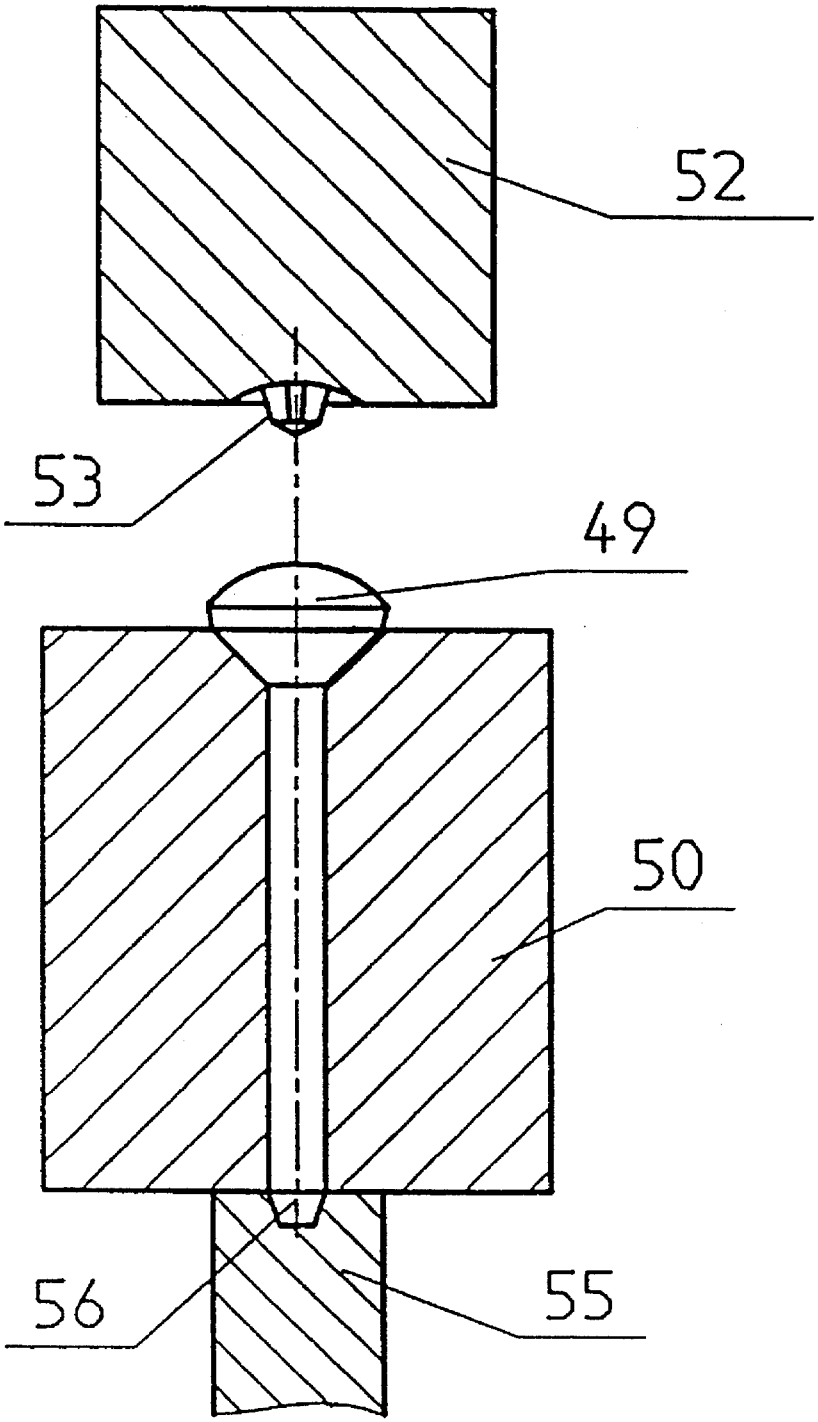

Many types of blanks are moreover to be provided with a so-called point, which may e.g. have the shape of a truncated cone at the end of the blank opposite the head. FIG. 11 shows an example of how such a point can be produced simultaneously with the provision of the slot in the head of the screw. FIG. 11 corresponds to FIG. 10A, there being just used a bottom stop 55 here which is provided with a frustoconical cavity 56 arranged in direct extension of the through hole in the die 50. The head on the blank 49 has been shaped in the previously pre-forming process such that there is an excess of material with respect to the size of the finished head on the screw. When the slot projection 53 hits the head on the blank 49, it presses the excessive material down through the shank of the blank. Thus, flow of material will take place in the entire length of the blank, and the material will be pressed out into the frustoconical depression 56 in the bottom stop 55.

It will be appreciated that it is possible to produce many different types of points in this manner, since the depression 56 can be given a shape that corresponds to the desired point type. It may be mentioned in particular that it will be possible to produce a hemispherical point, which required a separate process in the past. This is a simple manner of producing a point, and the flow of material down through the shank of the blank moreover causes the load on the tool 52 to be minimized, while the tolerances of the slot will be smaller. The method can also be applied in the production of screws without points. In that case, the depression 56 is shaped as a cylindrical depression having the same diameter as the hole in the die 50, or a bottom stop with a projection extending into the die may be used, said bottom stop being then merely moved slightly backwards from the die when the slot projection 53 produces the slot in the head of the blank.

An interesting aspect of the mentioned flow of material down through the shank of the blank is the part of the flow that takes place at the transition between the head and shank of the blank. The reason is that this flow has been found to strengthen the weak point which, otherwise, is traditionally found in screws at this transition.

In case of certain types of points it may be necessary or advantageous to produce the point in two steps. If so, a first depression is shaped in the bottom stop 46 which is used in the second pre-forming of the head of the screw blank.

It is described above how a blank can be formed in three die positions. This, however, is merely an example, since the three positions may be used flexibly depending upon the shape of the desired objects, or if necessary, more than three positions may be used for the forming.

Figure 12:
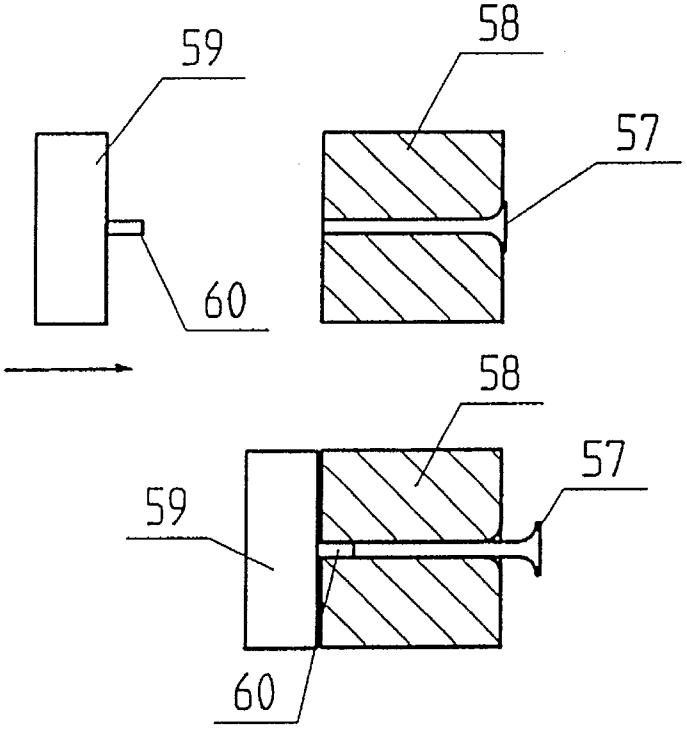

In the machine shown in FIG. 1 with five dies in the die table 17 and thus correspondingly five positions for each die, the last two positions may be used for ejection of the blank, and this ejection can then take place in two steps. FIG. 12 shows the first step of this ejection and thus corresponds to the fourth die position. A blank 57 placed in a die 58 is visible at the top of the figure, which shows the situation immediately before ejection. A bottom stop 59 with a short ejector pin 60 is being moved toward the die. At the bottom of the figure, the bottom stop 59 with the short ejector pin 60 has reached the die 58, and the ejector pin 60 has loosened the blank 57 and pushed it a short and well-defined distance out of the die 58. Because of the preceding processes the blank 57 will often be very firmly fixed in the hole of the die, and a very great force is therefore required to release the blank and push it out of the die. If the blank should have been pushed out of the die in one operation, this would have required an ejector pin which had the same length as the die, and this would therefore involve a very great risk of pin bending or breaking. Since the short ejector pin 60 can release the object with a great force without any risk of deflection, release of the blank from the die need not be facilitated by means of lubrication or the like.

Figure 13:
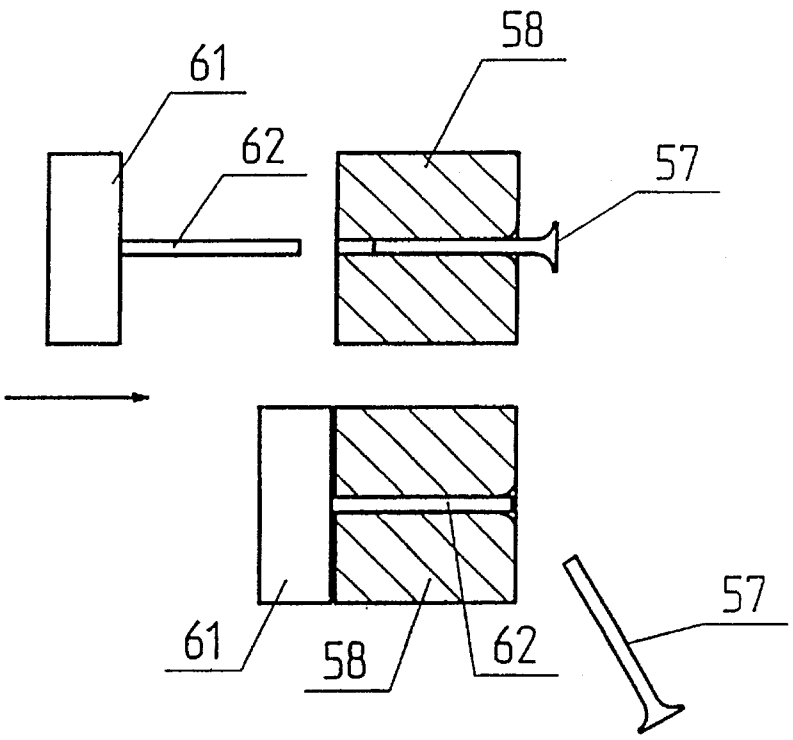

FIG. 13 shows how the blank 57 is then ejected completely from the die 58 at the fifth and last die position. This takes place in that a bottom stop 61 with a long ejector pin 62 pushes the blank out of the die. The ejector pin 62 has approximately the same length as the die 58 and thus as the blank 57. The top of the figure shows the bottom stop 61 and the long ejector pin 62 on their way toward the die 58, and at the bottom of the figure the bottom stop 61 and the ejector pin 62 have pushed the blank 57 completely out of the die 58. Since the blank 57 having been released in the preceding die position by means of the short ejector pin 60, is now positioned relatively loosely in the die, only a modest force is required to eject the blank completely, and the long ejector pin 62 will therefore not tend to break or bend.

Both the short ejector pin 60 and the long ejector pin 62 may have the same diameter as the shank of the blank 57, since an optional point on the blank 57, as described before and shown in FIG. 11, will be produced by means of a depression in the corresponding bottom stop 55. In the past, it was necessary to produce such a point by making a constriction in the die itself, and an ejector pin could only have a diameter corresponding to the narrowest portion of the die.

Figure 14B:
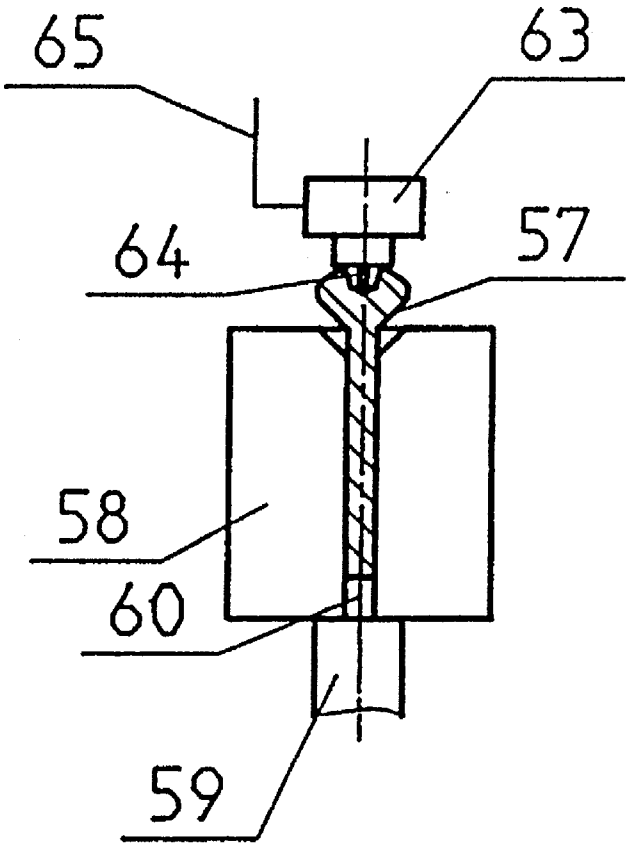
Figure 14A:
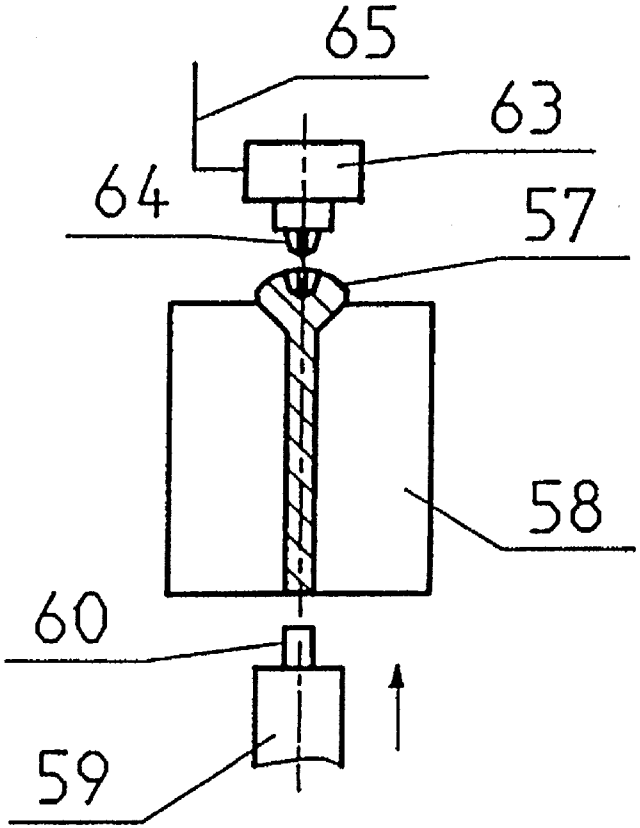

Since, as shown in FIG. 12, the short ejector pin 60 pushes the blank 57 a short and well-defined distance out of the die, this may be utilized for controlling the blank produced. FIG. 14 shows an example of how this may be done. The figure corresponds to FIG. 12, but includes a slot detector 63 comprising a control bit 64 which is arranged at a carefully determined distance from the die 58. The slot detector 63 is connected via a connection wire 65 to electronic equipment capable of processing the signals emitted from the slot detector 63. It is shown at the bottom of the figure how the short ejector pin 60 has pushed the blank 57 out of the die 58, and that the blank contacts the control bit 64. If the slot projection 53, by means of which the slot in the screw was made, has e.g. been damaged, the slot may be too small, and the blank 57 will then exert a pressure against the control bit 64. This is registered by the slot detector 63 which transmits signals about this to a control unit via the connecting wire 65. Thus, in this manner it is possible to control the geometry of the produced blanks.

Since the blank has been pushed out of the die, it is also possible to control e.g. the height or diameter of the head in addition to a possible slot.

Furthermore, the distance between the die and the tool table may be detected, and the signals from the detector 63 may be used for adjusting the tools. When the machine starts from a cold state, the machine parts will be heated owing to the processes in the machine and these parts will be thermally expanded at the same time. It may therefore be an advantage that these expansions can be allowed for by adjusting the position of the tools with respect to the dies in the die table 17. This can be done since, as mentioned before and shown in FIG. 1, it is possible to displace the entire tool table 2, and when such a displacement is effected in response to the control signals from the detector 63, a more uniform quality will be obtained which is not dependent on thermal heating in the machine.

The shown slot detector is just one of the many available possibilities of making a control measurement of the blanks produced. Measurements of other geometrical properties of the produced objects can be made, and it is also conceivable to make the measurement in other ways. Thus, e.g. a measurement may be made by means of laser beams so that the detector need not be in contact with the produced objects.

Figure 15:
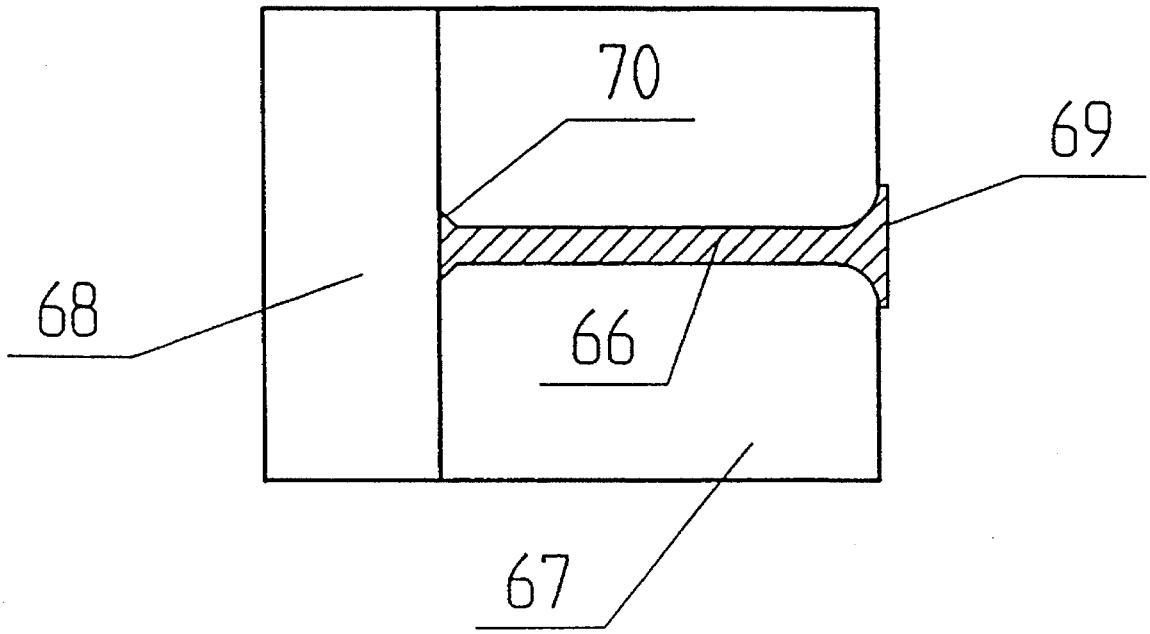

When e.g. a slot is made in a head on a blank, as described above and shown in FIG. 10, there is a certain risk that the slot tool unintentionally pulls the blank out of the die. This can be counteracted as shown in FIG. 15. Here, a blank 66 positioned in a die 67 and a bottom stop 68 are visible. The blank has a head 69 at one end, and it will be seen that a small holding flange 70 is provided at the opposite end of the blank. The flange is provided in that the die 67 at this end has a small expansion of the through hole. The pre-upsetting process, which has been described and is shown in FIG. 4, also causes material to be pressed out into this expansion, thereby making the flange 70. However, the flange does not necessarily extend all the way round the blank, since a smaller projection on the blank will be sufficient to perform the desired function, viz. to protect the blank against being pulled out of the die at an unappropriate time. The flange or the projections are just large enough to prevent this and also small enough for an ejector pin, in the subsequent ejection of the blank, to be able to deform the flange or the projections and eject the blank from the die.

Figure 16:
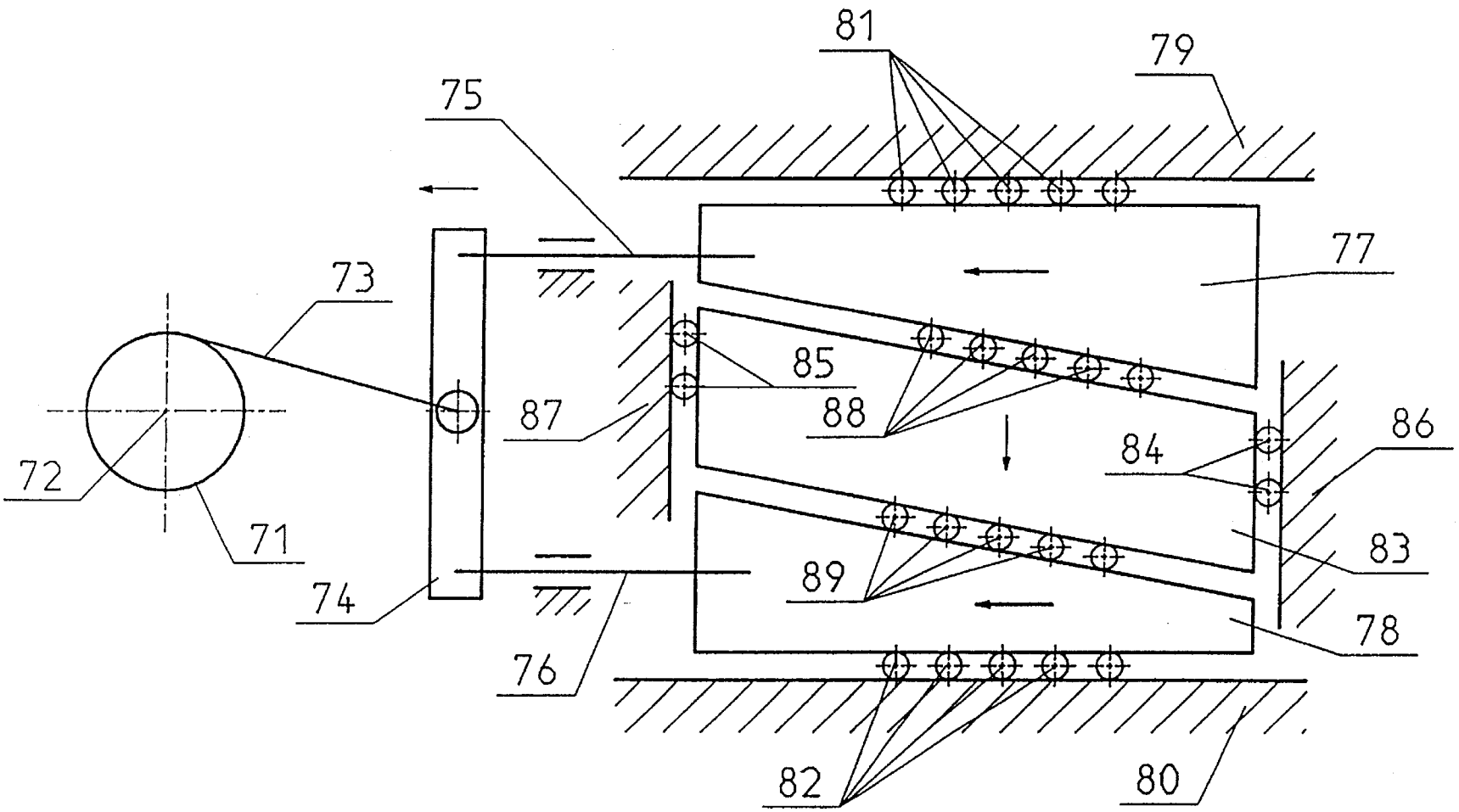

It is shown in FIG. 16 how the reciprocating movement of the die table 17 and the associated bottom stops can be established. As described before and shown in FIG. 1, this axial movement is provided by a motor 5, and the power transmission from the motor 5 takes place via belts 19, 20 and a crank mechanism 4. FIG. 16 shows in greater detail how this mechanism is constructed.

A crank 71 rotates about its axis of rotation 72 and is driven by the belt 20, as mentioned. A connecting rod 73 is secured to the crank 71 at one end and to a holder 74 at the other. When the crank 71 rotates, the rotating movement is converted via the connecting rod 73 to a reciprocating movement of the holder 74. The holder 74 is connected with two wedges 77, 78 via two rods 75, 76 such that these wedges, too, can be reciprocated. For this reciprocating movement to take place with a very small friction, a plurality of rollers 81 and 82, respectively, are positioned between the wedges 77, 78 and guide rails 79, 80. A bearing block 83 is interposed between the two wedges 77, 78, which is capable of being moved in a direction transversely to the direction of travel of the wedges. This movement, too, can take place with a very small friction, because rollers 84 and 85, respectively, are arranged between the bearing block and the guide rails 86, 87. Finally, a plurality of rollers 88 are also provided between the bearing block and the wedge 77 as well as a plurality of rollers 89 between the bearing block 83 and the wedge 78. When the wedges 77, 78 are moved to the left in the figure, the bearing block 83 will be moved in a downward direction in the figure because it can only move in the transverse direction. When similarly the wedges are moved to the right, the bearing block 83 will be moved upwardly. The bearing block 83 thus moves to and fro in a direction transversely to the corresponding movement of the wedges.

It will be seen that the wedge angle selected in the figure will cause the movement of the bearing block to be smaller than that of the wedges. The bearing block 83 is connected via connections (not shown) with the die table 17 and the associated bottom stops, respectively.

In this manner the die table 17 can perform a relatively short reciprocating movement, it being simultaneously possible to exert great forces which are necessary in the forming of the blanks positioned in the dies. Because of the wedge angle shown in the figure the wedges and thereby the crank mechanism will perform a greater movement, but then a smaller force is required, and the crank mechanism can therefore be dimensioned smaller than would otherwise be necessary.

Figure 17:
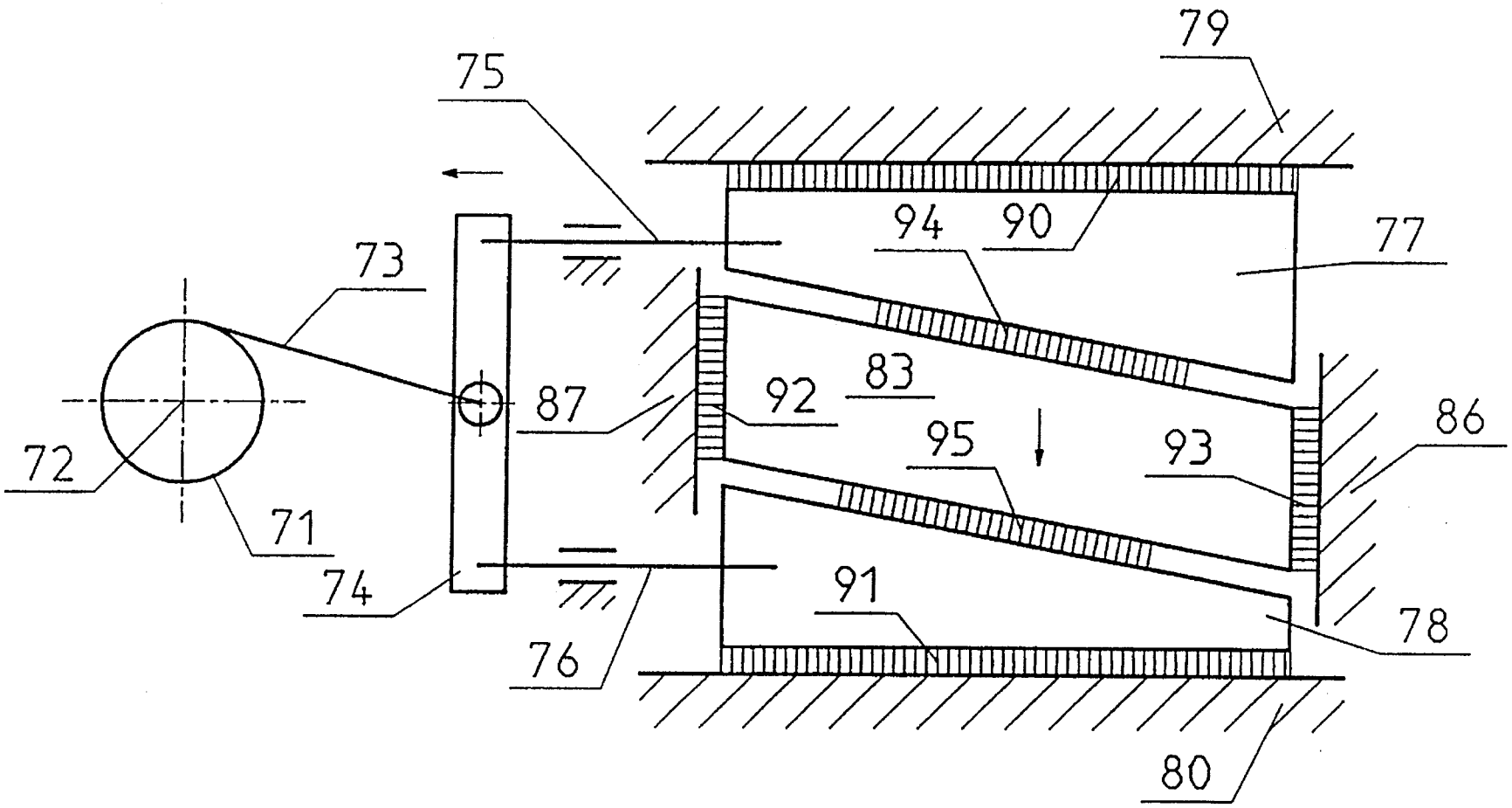

The rollers 81, 82, 84, 85, 88 and 89 shown in FIG. 16, which serve to reduce the friction between the individual components, may also have other shapes. Thus, e.g. balls may be used instead. An alternative embodiment is shown in FIG. 17 in which slide guides are used instead. The slide guides 90, 91 reduce the friction between the wedges 77, 78 and the guide rails 79, 80, while the slide guides 92, 93 correspondingly reduce the friction between the bearing block 83 and the guide rails 86, 87. Finally, the slide guides 94, 95 serve to reduce the friction between the bearing block 83 and the wedges 77, 78.

It is of great importance that the production rate of a machine of the type described here can be as high as possible. At the same time, the speed of the die at the beginning of the actual forming should be as low as possible. This is achieved i.a. by using a wedge mechanism, as described above, the wedge angle being selected such that the movement of the bearing block and thereby of the die table has a relatively small length of stroke. Furthermore, the velocity at which the die table approaches its extreme positions in such a movement differs. This is shown in FIGS. 18 and 19.

Figure 18:
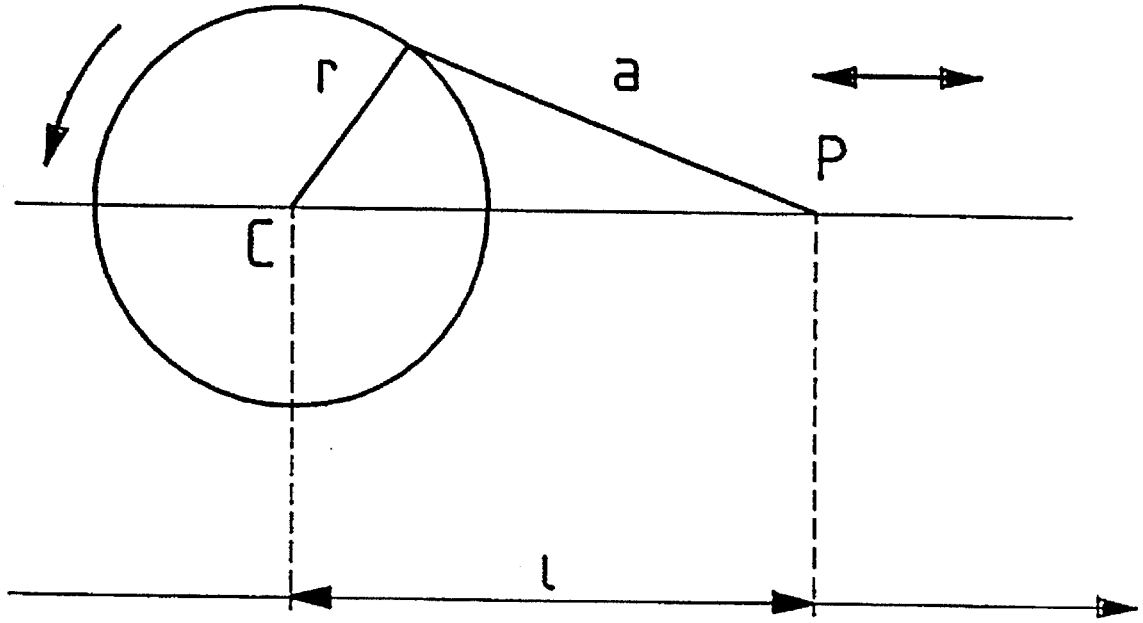
Figure 19A:
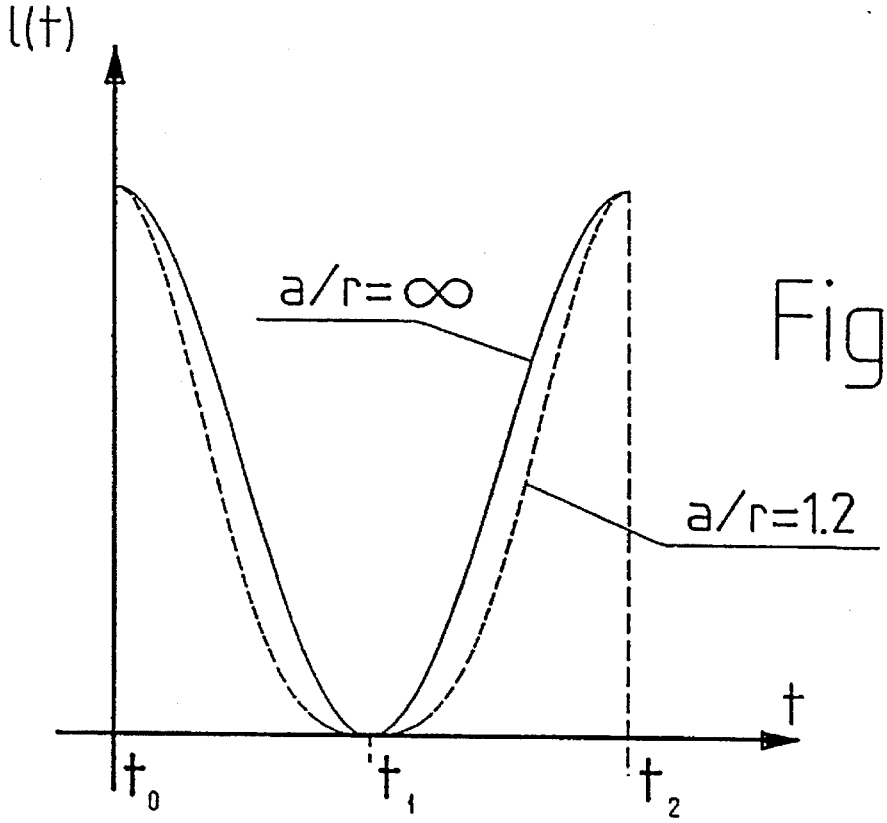
Figure 19B:
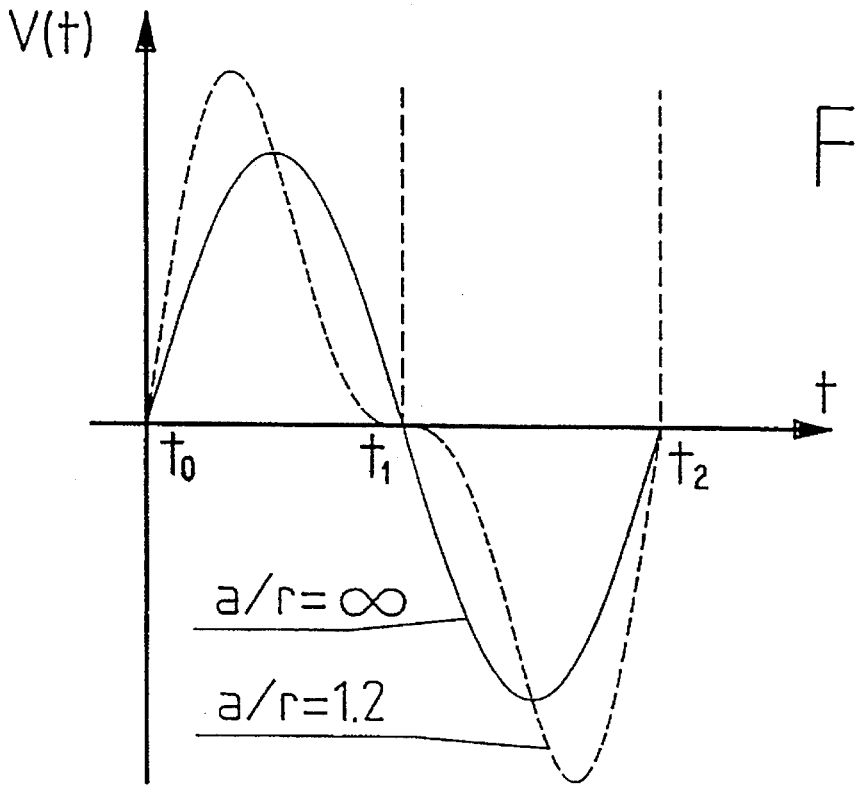

FIG. 18 schematically shows a crank mechanism. The crank rotates about an axis of rotation C. At its one end a connecting rod of the length a is secured to the crank at a distance r from its center or axis of rotation. Rotation of the crank causes the point P, which designates the other end of the connecting rod, to perform a reciprocating movement on the horizontal line. l designates the distance from the axis of rotation C to the point P. The distance 1 is shown at the top of FIG. 19 as the function of time at a constant crank speed of rotation. If the length a is very great with respect to the distance r, the point P will perform a pure sine movement, which is shown with the first of the two curves. If, on the other hand, the length a is short with respect to the distance r, the sine curve will be distorted. The smaller a is with respect to r, the more pronounced the distortion is. In the extreme case where a is equal to r, the point P will lie still for half of a period of rotation. The other curve at the top of FIG. 19 shows the movement of the point P in the situation where a is equal to 1.2 times r. It will be seen that the point P relatively slowly approaches the extreme position which is passed at the time t1, while, on the other hand, it relatively quickly approaches the other extreme position, as shown at t0 or t2. The bottom of FIG. 19 correspondingly shows the speed of the point P as a function of time for the same two situations. It is even more clearly visible from this that the point P approaches one extreme position at a relatively low speed and the other extreme position at a relatively high speed. To achieve the lowest possible working rate for a given production rate, the die table is therefore connected with the bearing block 83 such that forming of the blanks mounted in the dies takes place at that one of the extreme positions of the die table where it approaches the position at the lowest speed.

As described before, the die table 17 and the associated bottom stops are moved as a common unit towards the tools at the forming moment and then away from these again. However, at the opposite extreme position the die table must be separated from the bottom stops for the die table to rotate to a new position. This can be done by mounting a stop means which prevents the die table from following the bottom stops to their extreme position. This, however, will give rise to generation of much noise and great wear on the die table, partly when the die table hits the stop means, and partly when the bottom stops again hit the die table on their way back. This problem can be remedied by inserting transition periods where the die table is slowed down before hitting the stop means and is accelerated before being hit by the bottom stops.

Figures 20A, 20B, 20C, 20D:
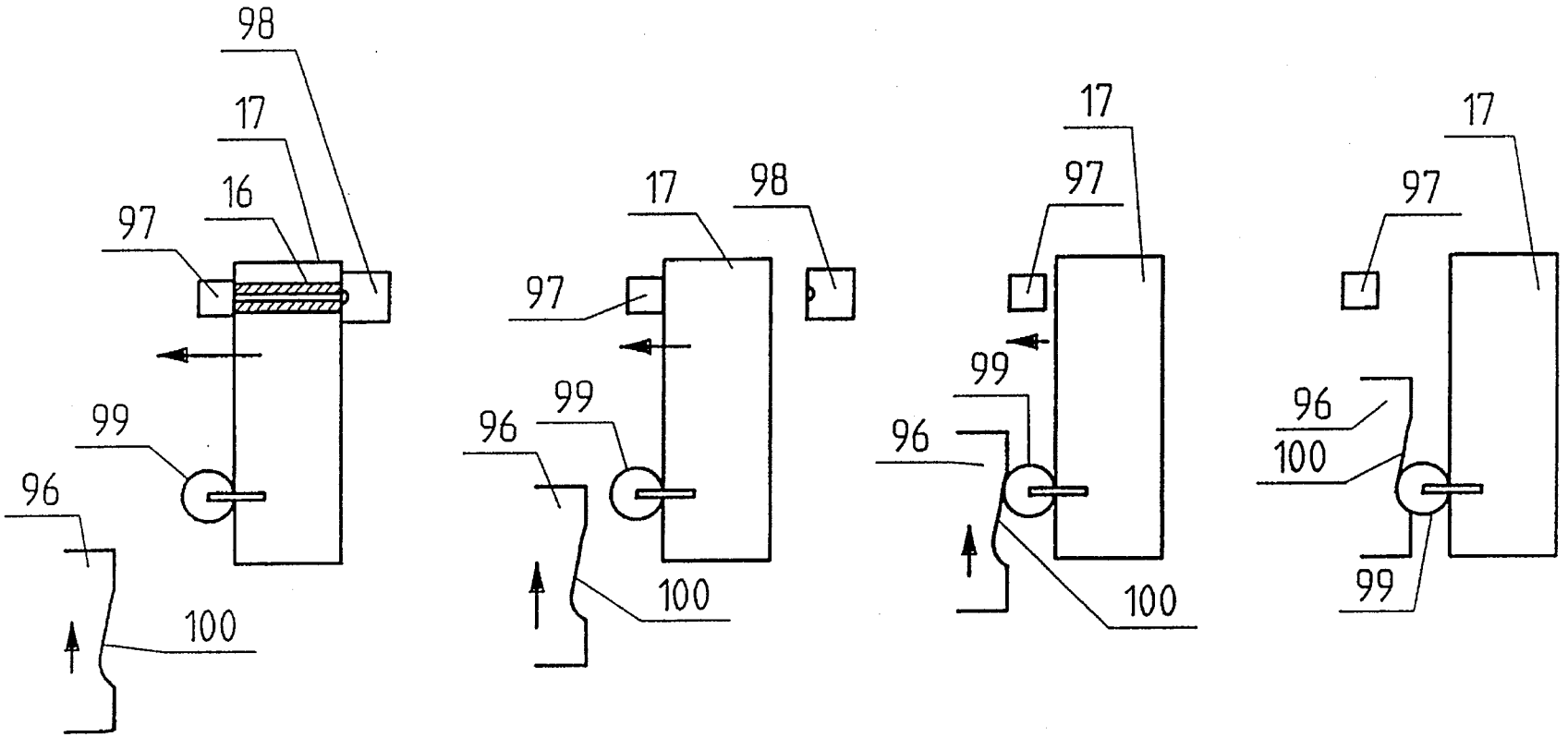

It is shown in FIG. 20 how this can be done through the aid of a cam means 96. In FIG. 20A the die table 17 is shown in the extreme position in which it is in contact with the tools, here e.g. the tool 98. As will be seen from the figure, a bottom stop 97 is in contact with the die table 17 at its opposite end. The cam means 96 is provided with a curve path 100, and it is moved in a direction transversely to the axial direction of travel of the die table. It is shown by arrows in the figure that the die table 17, after the contact with the tool 98, is moved away from it in the direction of the arrow while the cam means 96 is moved in an upward direction. As will be seen from the figure, the cam means 96 is provided with a curve path 100, while a roller 99 is mounted on the die table 17.

FIG. 20B shows the situation where the die table 17 together with the bottom stop 97 has been moved away from the tool 98 and is about to hit the cam means 96, which continues its upwardly directed movement. In FIG. 20C, the roller 99 has contacted the curve path 100. The curve path 100 is shaped such that together with the speed of the cam means 96 it entails that the die 17, immediately after contact between the roller 99 and the curve path 100, will continue at an unchanged velocity and is then slowly braked. It will be seen from the figure that the bottom stop 97 continues its movement and is therefore no longer in contact with the die table 17. FIG. 20D shows the situation in the extreme position where both the die table 17 and the bottom stop 97 are removed from the tools. The die table 17 is now separated from the bottom stop 97 and can rotate to a new position. Then the process proceeds in the opposite direction. The bottom stop 97 is moved forwardly toward the die table 17, which is simultaneously accelerated because of the cooperation between the curve path 100 and the roller 99, the cam means 96 now moving in a downwardly extending direction. Owing to the shape of the curve path 100 the die table 17, when being hit by the bottom stop 97, will have attained precisely the speed which the bottom stop has at this moment.

Figure 21A:
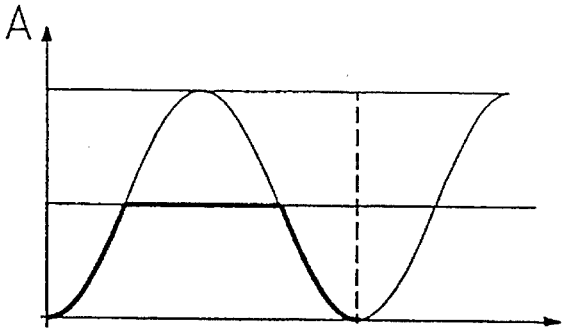
Figure 21B:
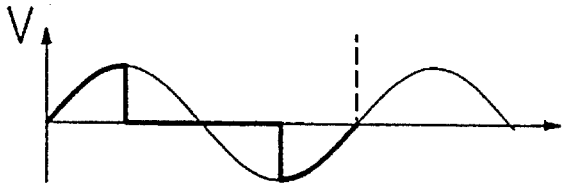
Figure 22A:
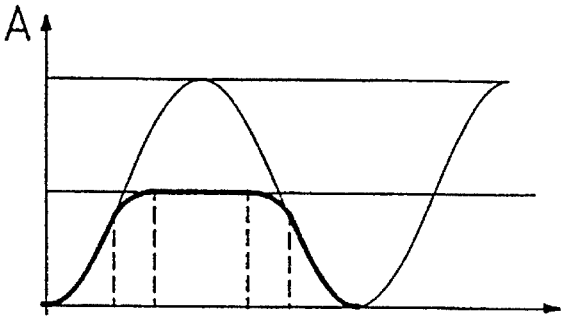
Figure 22B:
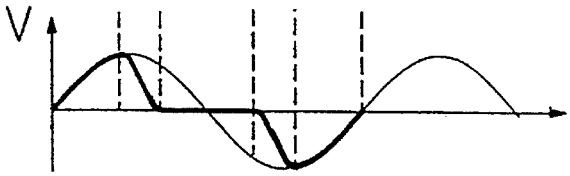
Figure 23A:
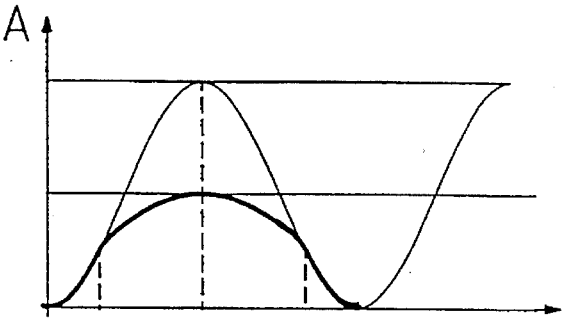
Figure 23B:
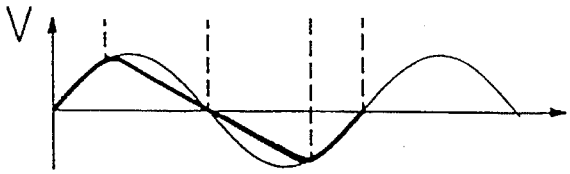

FIGS. 21, 22 and 23 show the movement and the speed of the die table 17 and the bottom stop 97, respectively, in three different situations. The tops of the figures show the movement expressed by the distance A from the tools. The movement of the bottom stop 97 is shown in thin line, while the movement of the die table 17 is shown in thick line. The bottoms of the figures correspondingly show the velocity (V) of the bottom stop in thin line and of the die table in thick line.

FIG. 21 shows the situation where there is no transition period, so that the die table 17 merely hits a stop means on its way away from the tools and is then hit by the bottom stop on its way toward the tools. The movement of the bottom stop is here shown as a pure sine curve. As mentioned above, this will be the case only if a connecting rod having a very long length with respect to the size of the crank is used. The correct curve will be distorted as shown in FIG. 19. It will be seen that for half a period the die table will be present in a dwell position where it can be rotated, while the bottom stop continues with a harmonic movement to its extreme position and then returns.

In FIG. 22, transition periods are inserted between the working period where the die table 17 moves together with the bottom stop 97 and the dwell period where the die table stands still.

FIG. 23 shows a situation where the transition periods have been made very long so that the dwell period is short or zero. This has the advantage that also the die table 17 performs a harmonic movement and is therefore subjected to the lowest possible forces in the axial direction because of the movement.

Figure 24:
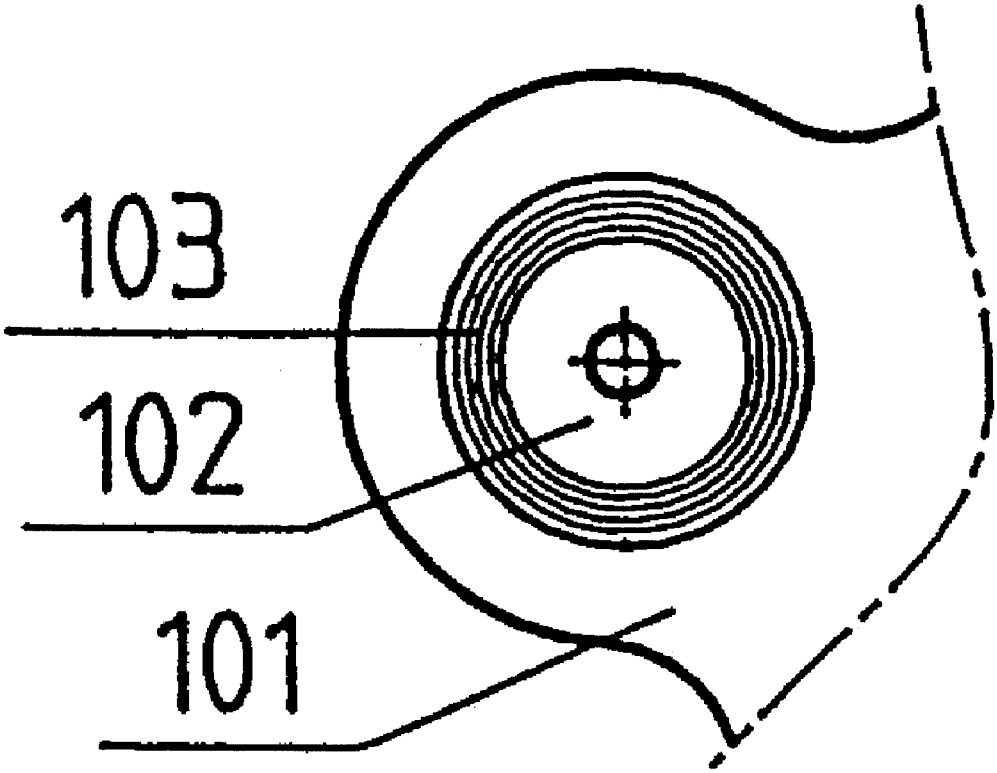

FIG. 24 shows a section of a die table 101 in which a die 102 is mounted. A band winding 103 is applied around the die 102. This band winding has been provided by winding a steel band around a cylindrical core, which may either be the die 102 itself, which is made of hard metal, or a cylindrical insert. The band winding 103 biasses the die 102 by absorbing the outwardly directed forces which occur when the die 102 is subjected to strong compressive stresses in the axial direction.

Figure 25:
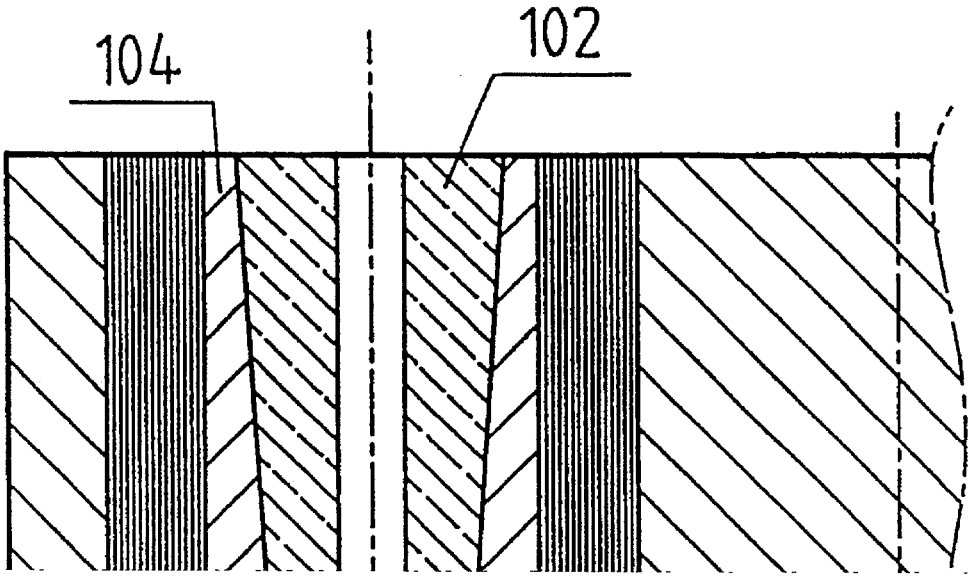

FIG. 25 shows a section through part of the die table 101, and it is shown more clearly in this section how the die 102 may be mounted in the die table 101. The die 102 here has a conical shape and is mounted in a bushing 104, whose interior has a conical shape corresponding to that of the die. The bushing 104 is wound with the band winding 103, which is in turn placed in a suitable hole in the die table 101. This structure has the advantage that the die 102, because of the conical shape, can easily be replaced by pressing it out of the bushing 104. A new die can be pressed down into the conical bushing 104 and thus ensure that the die is biassed correctly.

Figure 26:
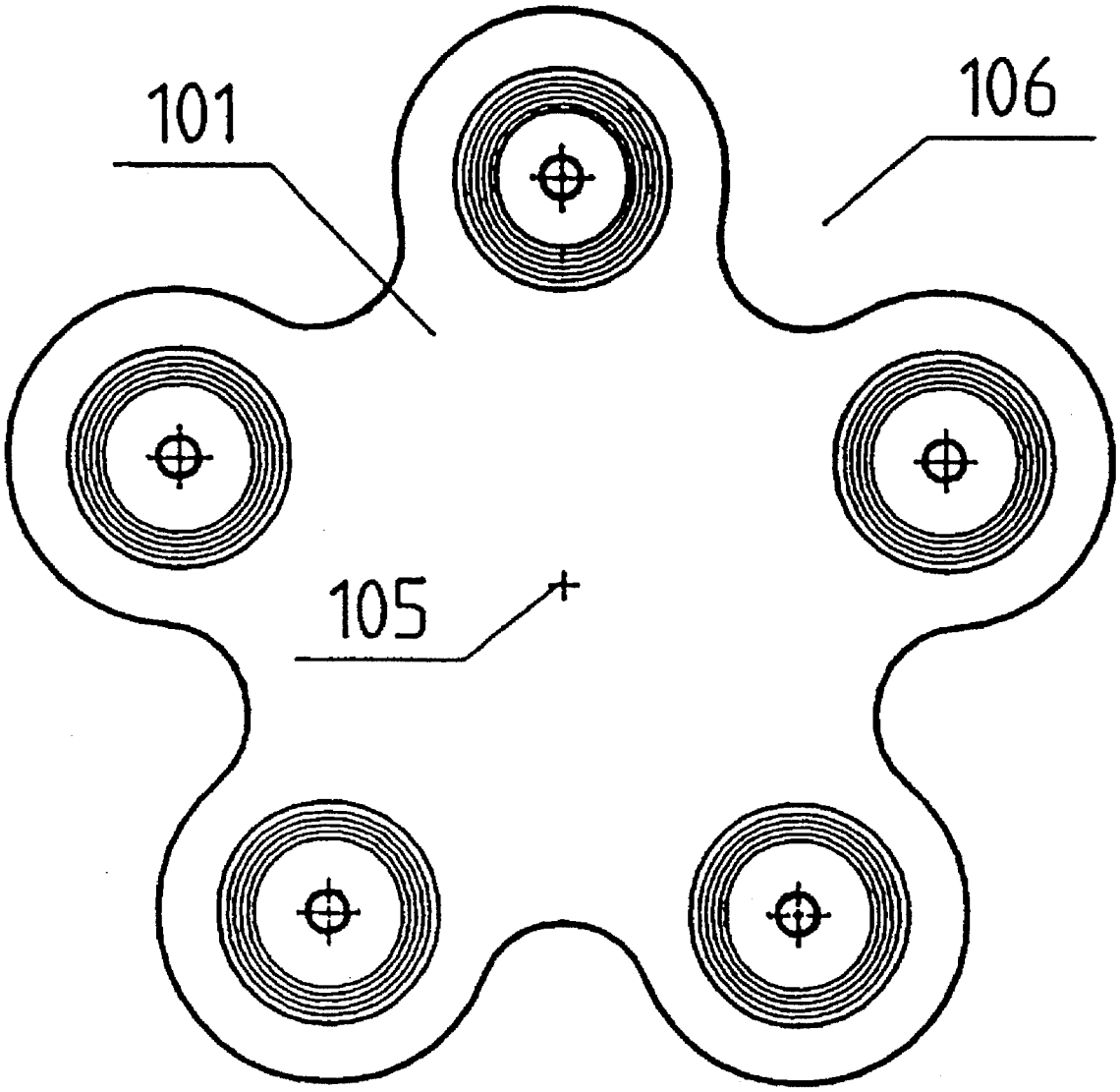

The advantage of biassing the hard metal die in this manner by means of a band winding is that the die unit, including bias, can be given a very small cross-sectional area. This means that the dies in a die table can be positioned more closely to the axis of rotation of the die table and thus contribute to reducing its moment of inertia. FIG. 26 shows an example of the shape of a die table 101. In this case the die table has five dies, all of which are biassed by means of band windings as described above. For a high production rate to be achieved, the die table must have as low a moment of inertia as possible. This is achieved partly in that the dies, including bias by means of band windings, have a modest extent, and partly because they can then be positioned more closely to the axis of rotation 105 of the die table. The moment of inertia of the die table is then additionally diminished by a recess 106 between each die, such that the die table has the shape of a clover leaf. This contributes to reducing the moment of inertia of the die table considerably, because precisely that portion of the material is removed which is most remote from the axis of rotation 105 and thereby contributes most to the moment of inertia.

Further, it also contributes to reducing the moment of inertia that dies having the same length as the blanks are used here. The known machines usually employ longer and thus heavier dies.

The small moment of inertia entails that the die table can be driven directly by a servomotor having a high production rate.

The foregoing description gives examples of how a machine according to the invention can be constructed, and it will be appreciated that details in the described and shown matter can be modified in many ways within the scope of the invention.

What is claimed is:

1. An apparatus for making fasteners each having a shank and a head, said apparatus comprising:

a stationary cropping bushing, at least two movable cropping bushings, a transport device for moving said movable cropping bushings conjointly and successively between a receiving position adjacent to said stationary cropping bushing and a discharge position such that when one movable cropping bushing is located adjacent to said stationary cropping bushing in said receiving position the other movable cropping bushing is located at said discharge position, a die at said discharge position located in spaced relation from said movable cropping bushings, when the latter are at said discharge position, to define a determined unrestricted axial space therewith, means for advancing a wire through an axial hole in said stationary cropping bushing into an axial hole provided in each of said movable cropping bushings when the latter are at said receiving position, said movable cropping bushings each separating a blank from said wire when moving from said receiving position to said discharge position, a punch at said discharge position on a side of the movable cropping bushing thereat opposite said die, and means for moving said punch into the hole of the movable cropping bushing at said discharge position to displace the blank in said hole into said die and upset said blank in said unrestricted axial space between the die and said movable cropping bushing to preform a head on said blank in said space, said blank having a portion in said die which forms a shank for said head.

2. Apparatus as claimed in claim 1, wherein a plurality of said dies are provided and are movable such that each die is successively positioned adjacent to the movable cropping bushing at said discharge position.

3. Apparatus as claimed in claim 2, comprising means for coordinating the movements of said dies and said punch including a crank assembly connected to said dies and punch.

4. Apparatus as claimed in claim 2, wherein said transport device comprises a rotatable cropping table supporting said movable cropping bushings.

5. Apparatus as claimed in claim 4, comprising a rotatable and axially displaceable member supporting said plurality of dies.

6. Apparatus as claimed in claim 1, comprising means for separating the die with the blank from the movable cropping bushing after preforming said head on the blank, finishing means for finishing the forming of said head, and means for transporting said die and said blank from said discharge position to said finishing means.

7. Apparatus as claimed in claim 1, wherein more than two of said movable cropping bushings are provided, said transport device comprising a stepwise rotatable table, in which a first of said movable cropping bushings is at said receiving position, a second of said movable cropping bushings is at said discharge position and a remaining number of movable cropping bushings are between the first and second movable cropping bushings and are moved in steps as said table rotates.

8. Apparatus as claimed in claim 1, comprising a stop member on said die to limit displacement of the blank into the die.

9. Apparatus as claimed in claim 8, wherein said stop member is adjustable to regulate an amount of said displacement of the blank into the die.

10. Apparatus as claimed in claim 1, wherein said die is axially movable towards and away from the movable cropping bushing at said discharge position, said die initially being adjacent to said movable cropping bushing and undergoing movement away from said movable cropping bushing to form said determined unrestricted axial space.

11. Apparatus as claimed in claim 10, comprising means for coordinating the movements of said die and said punch.

12. Apparatus as claimed in claim 10, wherein said movable cropping bushings each has a surface which faces an opposed surface of said die when each said movable cropping bushing is at said discharge position, said surfaces of said movable cropping bushings and said die having respective cavities to facilitate initial formation of the preformed head.

13. Apparatus as claimed in claim 1, comprising means for moving said die together with the blank away from said movable cropping bushing which then permits the movable cropping bushing to return to said receiving station to receive another blank.

* * * * *

UNITED STATES PATENT AND TRADEMARK OFFICE

CERTIFICATE OF CORRECTION

PATENT NO. : 5,524,471

DATED : June 11, 1996

INVENTOR(S) : Ove Nielsen

It is certified that error appears in the above-identified patent and that said Letters Patent is hereby corrected as shown below:

On the title page, item "[86] PCT No.: PCT/DE93/00078" should read --[86] PCT No.: PCT/DK93/00078--

Signed and Sealed this

Seventeenth Day of September, 1996

*Attest:*

*Attesting Officer*

Bruce Lehman

BRUCE LEHMAN

*Commissioner of Patents and Trademarks*